US010875302B2

(12) United States Patent
McMullen et al.

(10) Patent No.: US 10,875,302 B2
(45) Date of Patent: Dec. 29, 2020

(54) DROPLET DEPOSITION HEAD AND ACTUATOR COMPONENT THEREFOR

(71) Applicants: Robert Errol McMullen, Cambridge (GB); Peter Mardilovich, Cambridge (GB); Peter Boltryk, Cambridge (GB)

(72) Inventors: Robert Errol McMullen, Cambridge (GB); Peter Mardilovich, Cambridge (GB); Peter Boltryk, Cambridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/334,258

(22) PCT Filed: Oct. 5, 2016

(86) PCT No.: PCT/GB2016/053103

§ 371 (c)(1),
(2) Date: Mar. 18, 2019

(87) PCT Pub. No.: WO2018/051051

PCT Pub. Date: Mar. 22, 2018

(65) Prior Publication Data

US 2020/0009866 A1 Jan. 9, 2020

(30) Foreign Application Priority Data

Sep. 16, 2016 (GB) ..... 1615854.5

(51) Int. Cl.
*B41J 2/14* (2006.01)

(52) U.S. Cl.
CPC ..... *B41J 2/14233* (2013.01); *B41J 2/14274* (2013.01); *B41J 2002/14241* (2013.01); *B41J 2002/14419* (2013.01); *B41J 2202/12* (2013.01)

(58) Field of Classification Search
CPC B41J 2/14233; B41J 2/14274; B41J 2202/12; B41J 2002/14419
(Continued)

(56) References Cited

U.S. PATENT DOCUMENTS 8,678,558 B2 3/2014 Hotta
9,682,559 B2 * 6/2017 Ikeuchi ..... B41J 2/14233
(Continued)

FOREIGN PATENT DOCUMENTS

EP 0 799 699 A2 10/1997
EP 2 990 205 A2 3/2016
(Continued)

OTHER PUBLICATIONS

International Search Report for International Application No. PCT/GB2016/053103 dated Jun. 9, 2017 (9 pages).
(Continued)

*Primary Examiner* — An H Do
(74) *Attorney, Agent, or Firm* — Finnegan, Henderson, Farabow, Garrett & Dunner, LLP

(57) ABSTRACT actuator component for a droplet deposition head made up of a number of patterned layers, each layer extending in a plane normal to a layering direction, with the layers being stacked one upon another in said layering direction. A row of fluid chambers is formed within the layers, with the row extending in a row direction, which is substantially perpendicular to the layering direction. Each fluid chamber is provided with a respective nozzle and a respective actuating element, which is actuable to cause the ejection of fluid from the chamber in question through the corresponding one of the nozzles. A row of inlet passageways is also formed within the layers of the actuator component, with the row extending in the row direction. Each inlet passageway is fluidically connected so as to supply fluid to a respective one of said
(Continued)

fluid chambers. In some embodiments, either a row of outlet passageways or a second row of inlet passageways is additionally formed within the layers; in either case, such row extends in the row direction. Where outlet passageways are present, each is fluidically connected so as to receive fluid from a respective one of said fluid chambers. At least one of the rows of passageways is staggered, whereby at least some of the members of the staggered row in question are offset from their neighbours in an offset direction for the staggered row in question that is perpendicular to the row direction. The row of fluid chambers may also be staggered.

20 Claims, 9 Drawing Sheets

(58) Field of Classification Search
USPC ..... 347/68, 70; 310/309, 330, 341
See application file for complete search history.

(56) References Cited

U.S. PATENT DOCUMENTS

| | | | |
|---|---|---|---|
| 10,532,572 | B2 * | 1/2020 | McMullen ..... B41J 2/14233 |
| 2003/0090538 | A1 | 5/2003 | Silverbrook et al. |
| 2005/0179732 | A1 | 8/2005 | Sato et al. |
| 2006/0061632 | A1 | 3/2006 | Mita |
| 2007/0024676 | A1 | 2/2007 | Kachi et al. |
| 2012/0281044 | A1 | 11/2012 | Andrews et al. |
| 2013/0016161 | A1 | 1/2013 | Hotta |
| 2015/0145927 | A1 | 5/2015 | Murochi |

FOREIGN PATENT DOCUMENTS

| | | | |
|---|---|---|---|
| GB | 2536942 | A | 10/2016 |
| JP | H09272205 | A | 10/1997 |
| JP | 2005147762 | A | 6/2005 |
| JP | 2012158170 | A | 8/2012 |
| JP | 2013018197 | A | 1/2013 |
| JP | 2015054510 | A | 3/2015 |
| JP | 2016049675 | A | 4/2016 |
| JP | 2016049683 | A | 4/2016 |
| WO | WO2016001679 | A1 | 1/2016 |

OTHER PUBLICATIONS

Search Report dated Mar. 16, 2017, from the United Kingdom Intellectual Property Office for corresponding United Kingdom Application No. GB1615854.5. (4 pgs.).

Notice of Reasons for Refusal from the Japanese Patent Office for corresponding Japanese Application 2019-514775 dated Jun. 16, 2020 (13 pages).

* cited by examiner

DROPLET DEPOSITION HEAD AND ACTUATOR COMPONENT THEREFOR

This application is a National Stage Entry of International Application No. PCT/GB2016/053103, filed Oct. 5, 2016, which is based on and claims the benefit of foreign priority under 35 U.S.C. § 119 to GB Application No. 1615854.5, filed Sep. 15, 2016. The entire contents of the above-referenced applications are expressly incorporated herein by reference.

The present invention relates to droplet deposition heads and actuator components therefor. It may find particularly beneficial application in a printhead, such as an inkjet printhead, and actuator components therefor.

Droplet deposition heads are now in widespread usage, whether in more traditional applications, such as inkjet printing, or in 3D printing, or other materials deposition or rapid prototyping techniques. Accordingly, the fluids may have novel chemical properties to adhere to new substrates and increase the functionality of the deposited material.

Recently, inkjet printheads have been developed that are capable of depositing ink directly onto ceramic tiles, with high reliability and throughput. This allows the patterns on the tiles to be customized to a customer's exact specifications, as well as reducing the need for a full range of tiles to be kept in stock.

In other applications, inkjet printheads have been developed that are capable of depositing ink directly on to textiles. As with ceramics applications, this may allow the patterns on the textiles to be customized to a customer's exact specifications, as well as reducing the need for a full range of printed textiles to be kept in stock.

In still other applications, droplet deposition heads may be used to form elements such as colour filters in LCD or OLED elements displays used in flat-screen television manufacturing.

So as to be suitable for new and/or increasingly challenging deposition applications, droplet deposition heads continue to evolve and specialise. However, while a great many developments have been made, there remains room for improvements in the field of droplet deposition heads.

SUMMARY

Aspects of the invention are set out in the appended claims.

BRIEF DESCRIPTION OF THE DRAWINGS

Reference is now directed to the drawings, in which:

FIGS. 10A, 10B, and 100 are plan views of cross-sections, each of which is taken through a corresponding inlet passageway according to a respective example design in which the inlet passageway is shaped so as to be self-symmetric.

DETAILED DESCRIPTION OF THE DRAWINGS

Figure 1A:
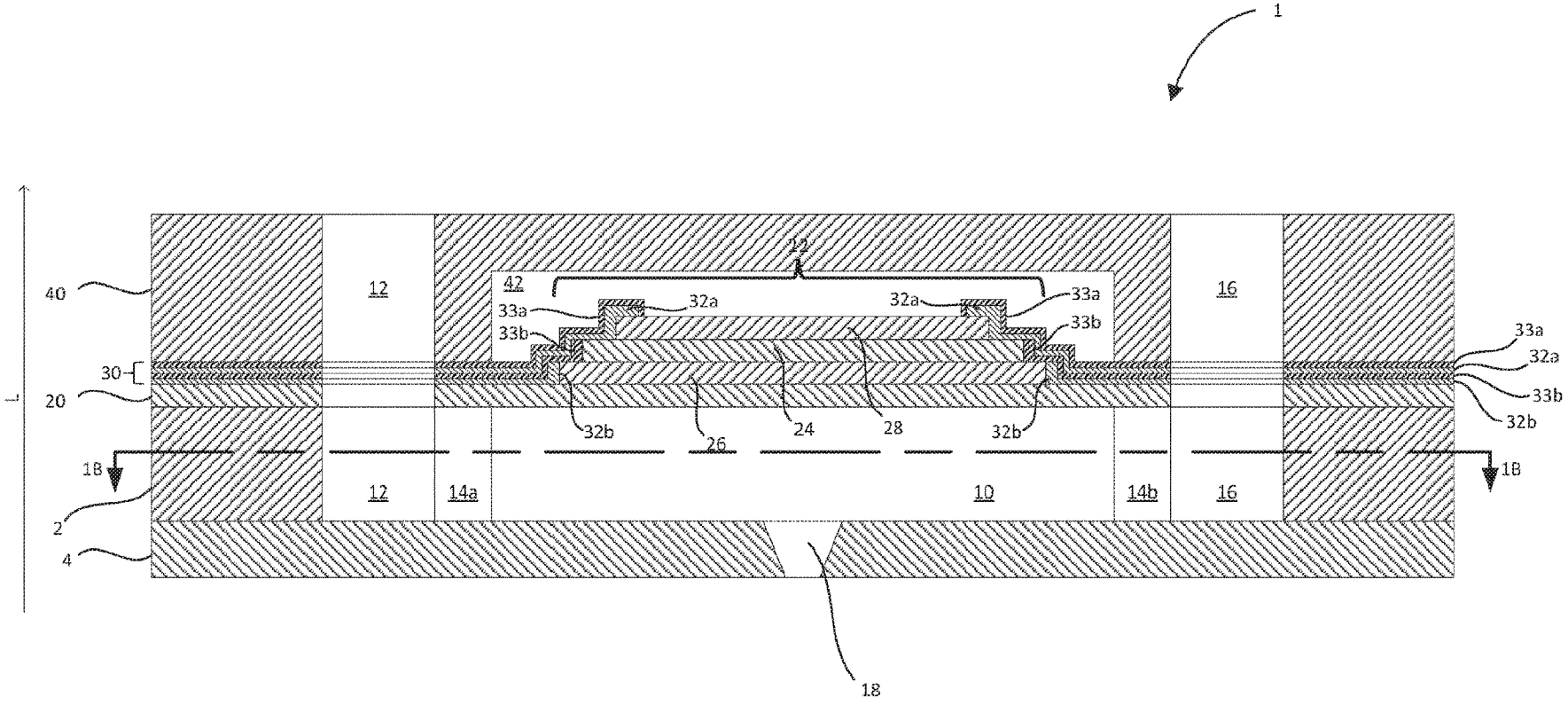
FIG. 1A is a plan view of a cross-section taken along the length of a fluid chamber of an actuator component according to an initial design by the Applicant.

The following disclosure describes an actuator component for a droplet deposition head comprising: an actuator component comprising a plurality of patterned layers, each layer extending in a plane having a normal in a layering direction, the layers being stacked one upon another in said layering direction; a row of fluid chambers formed within said plurality of layers, the row extending in an row direction, which is substantially perpendicular to said layering direction, each fluid chamber being provided with a respective nozzle and a respective actuating element, which is actuable to cause the ejection of fluid from the chamber in question through the corresponding one of the nozzles; a row of inlet passageways formed within said plurality of layers, the row extending in said row direction, each inlet passageway being fluidically connected so as to supply fluid to a respective one of said fluid chambers; a row of outlet passageways formed within said plurality of layers, the row extending in said row direction, each outlet passageway being fluidically connected so as to receive fluid from a respective one of said fluid chambers. At least one of said row of inlet passageways and said row of outlet passageways is staggered, whereby at least some of the members of the staggered row in question are offset from their neighbours in an offset direction for the staggered row in question which that is perpendicular to said row direction.

In embodiments, substantially all of the inlet passageways may have the same orientation. In addition, or instead, substantially all of the outlet passageways may have the same orientation. In addition, or instead, substantially all of the fluid chambers may have the same orientation.

The following disclosure also describes droplet deposition heads comprising such actuator components. Such droplet deposition heads may further comprise one or more manifold components that are attached to the actuator component. The manifold component(s) may convey fluid to the row of inlet passageways and may receive fluid from the row of outlet passageways. Such droplet deposition heads may, in addition, or instead, include drive circuitry that is electrically connected to the actuating elements, for example by means of electrical traces provided by the actuator component. Such drive circuitry may supply drive voltage signals to the actuating elements that cause the ejection of droplets from a selected group of chambers, with the selected group changing with changes in input data received by the head.

The following disclosure also describes an actuator component for a droplet deposition head comprising: an actuator component comprising a plurality of patterned layers, each layer extending in a plane having a normal in a layering direction, the layers being stacked one upon another in said layering direction; a row of fluid chambers formed within said plurality of layers, the row extending in an row direction, which is substantially perpendicular to said layering direction, each fluid chamber being provided with a respective nozzle and a respective actuating element, which is actuable to cause the ejection of fluid from the chamber in question through the corresponding one of the nozzles; at least a first row of inlet passageways formed within said plurality of layers, said first row extending in said row direction, each inlet passageway being fluidically connected so as to supply fluid to a respective one of said fluid chambers. The aforementioned first row of inlet passageways is staggered, whereby at least some of the members of the first row of inlet passageways are offset from their neighbours in an offset direction for the first row of inlet passageways, which that is perpendicular to said row direction.

In embodiments, substantially all of the inlet passageways may have the same orientation. In addition, or instead, substantially all of the fluid chambers may have the same orientation.

The following disclosure also describes droplet deposition heads comprising such actuator components. Such droplet deposition heads may further comprise one or more manifold components that are attached to the actuator component. The manifold component(s) may convey fluid to the row of inlet passageways. Such droplet deposition heads may, in addition, or instead, include drive circuitry that is electrically connected to the actuating elements, for example by means of electrical traces provided by the actuator component. Such drive circuitry may supply drive voltage signals to the actuating elements that cause the ejection of droplets from a selected group of chambers, with the selected group changing with changes in input data received by the head.

To meet the material needs of diverse applications, a wide variety of alternative fluids may be deposited by droplet deposition heads as described herein. For instance, a droplet deposition head may eject droplets of ink that may travel to a sheet of paper or card, or to other receiving media, such as textile or foil or shaped articles (e.g. cans, bottles etc.), to form an image, as is the case in inkjet printing applications, where the droplet deposition head may be an inkjet printhead or, more particularly, a drop-on-demand inkjet printhead.

Alternatively, droplets of fluid may be used to build structures, for example electrically active fluids may be deposited onto receiving media such as a circuit board so as to enable prototyping of electrical devices.

In another example, polymer containing fluids or molten polymer may be deposited in successive layers so as to produce a prototype model of an object (as in 3D printing).

In still other applications, droplet deposition heads might be adapted to deposit droplets of solution containing biological or chemical material onto a receiving medium such as a microarray.

Droplet deposition heads suitable for such alternative fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the input data provided to the head.

Reference is now directed to FIG. 1A, which is a plan view of a cross-section taken along the length of a fluid chamber 10 of an actuator component 1 for a droplet deposition head according to an initial design by the Applicant.

As may be seen from FIG. 1A, the example actuator component 1 includes a number of patterned layers that are stacked in a layering direction L (which in FIG. 1A is the vertical direction). As is also shown in FIG. 1A, each of the patterned layers extends in a plane perpendicular to the layering direction L.

In the particular actuator component 1 shown in FIG. 1A, the patterned layers include nozzle layer 4, fluid chamber substrate layer 2, membrane layer 20, wiring and passivation layers 30, and capping layer 40 (in that order). However, this particular combination of layers is by no means essential and, as will be explained in further detail below, additional layers may be included and/or certain layers may be omitted.

Figure 1B:
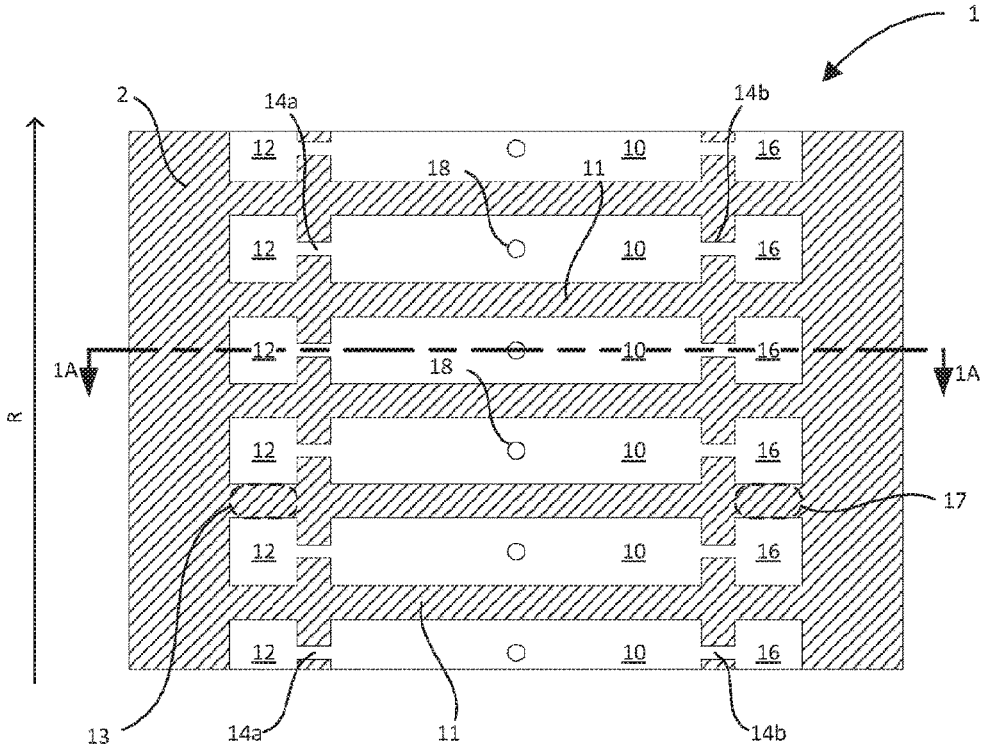
FIG. 1B is a cross-section taken in plane 1B indicated in FIG. 1A through the actuator component shown therein.

As may be seen from FIG. 1B, which is a cross-section taken in plane 1B indicated in FIG. 1A through fluid chamber substrate layer 2, a row of fluid chambers 10 is formed within the layers of the actuator component 1, with this row extending in a row direction R, which is substantially perpendicular to the layering direction. The row direction R is into the page in FIG. 1A.

Figure 1C:
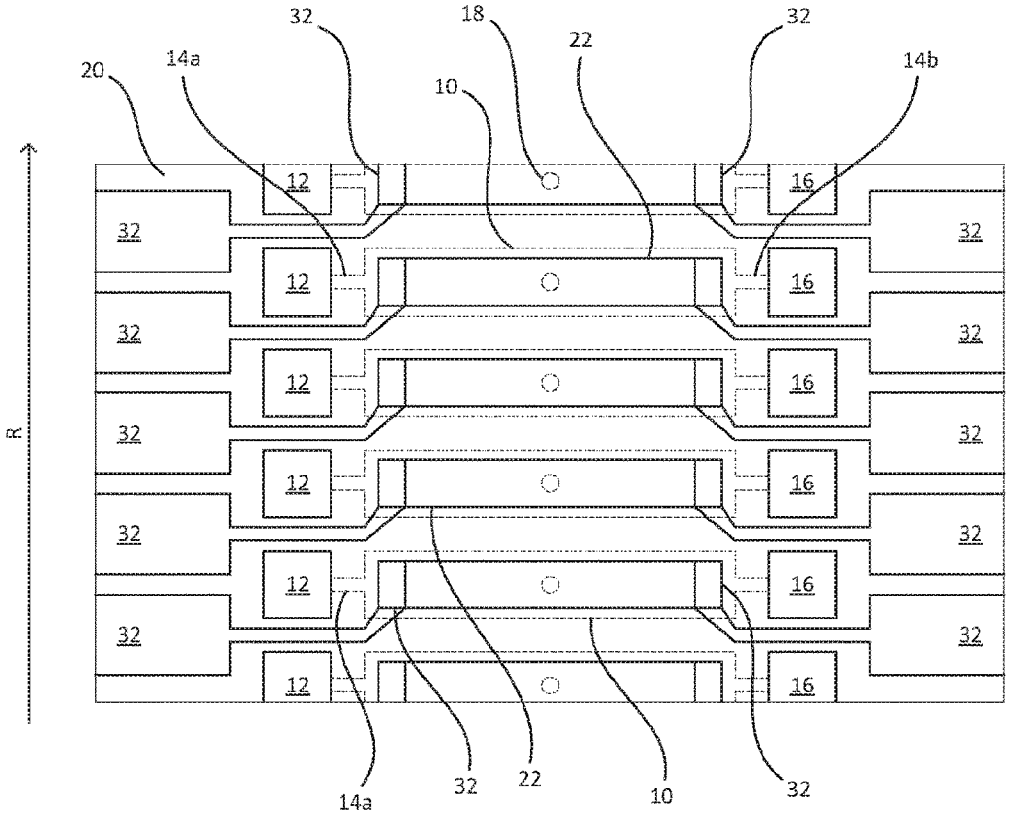
FIG. 1C is a plan view of the actuator component shown in FIG. 1A from the side to which the capping layer is attached, with the capping layer removed so as to show clearly an illustrative configuration of electrical traces.

As may also be seen from FIG. 1B, in the specific actuator component 1 of FIGS. 1A-1C, adjacent chambers within the row are separated by chamber walls 11. As shown in the drawing, the chambers 10 may be elongate in a direction perpendicular to the row direction R.

Also formed within the layers of the actuator component 1 are respective rows of inlet passageways 12 and outlet passageways 16, with each of these rows extending in the same row direction R as the row of fluid chambers 10. Thus, the rows of inlet passageways 12, outlet passageways 16 and fluid chambers 10 all extend parallel to one another.

Each inlet passageway 12 is fluidically connected so as to supply fluid to a respective one of the row of fluid chambers 10. Conversely, each outlet passageway 16 is fluidically connected so as to receive fluid from a respective one of the row of fluid chambers 10.

In the specific actuator component 1 of FIGS. 1A-1C, each inlet passageway 12 is fluidically connected to supply droplet fluid to one end of the corresponding one of the fluid chambers 10, whereas each outlet passageway 16 is fluidically connected to receive fluid from the other end of that fluid chamber 10.

In more detail, as is apparent from FIG. 1A, the inlet and outlet passageways 12 are fluidically connected to their corresponding ends of the fluid chamber 10 via respective flow restrictor passages 14*a*, 14*b*.

As shown in FIG. 1A, each of the fluid chambers 10 is provided with a respective nozzle 18 and a respective actuating element 22. In the specific example shown in FIGS. 1A-1C, the actuating element 22 is a piezoelectric actuating element and therefore includes a piezoelectric member 24; however, any type of actuating element that is actuable to cause the ejection of fluid from a chamber through a nozzle 18 corresponding to that chamber, could be employed. For instance, other types of electromechanical actuating elements, such as electrostatic actuating elements, could be utilised. Indeed, the actuating elements need not be electromechanical: they might, for example, be thermal actuating elements, such as resistive elements.

Where, as in the example of FIGS. 1A-1C, an electromechanical actuating element 22 is employed, this may function by deforming a wall bounding the corresponding one of the chambers. Such deformation may in turn increase the pressure of the fluid within the chamber and thereby cause the ejection of droplets of fluid from the nozzle. In the particular example shown in FIGS. 1A-1C, the piezoelectric actuating element 22 functions by deforming membrane layer 20.

Where a deformable wall is used, there may be a time-lag between the initial deformation of the wall and the increase in pressure that causes ejection. For instance, the wall might initially deform outwardly, causing a substantially instantaneous decrease in pressure, and then, a short time afterwards, move back to its undeformed position, causing a substantially instantaneous increase in pressure. In some cases, this returning motion may be suitably timed so as to coincide with the arrival in the vicinity of the nozzle of acoustic waves generated within the chamber by the initial outward movement of the wall. Thus, the acoustic waves may enhance the effect of the increase in pressure caused by the returning of the chamber wall to its undeformed position.

In further examples, the deformable wall might simply be actuated such that it initially deforms inwardly towards the chamber, thus causing a substantially instantaneous increase in pressure that causes ejection of a droplet.

As a result of the provision of inlet passageways 12 and outlet passageways 16, a droplet deposition head including an actuator component 1 such as that shown in FIGS. 1A-1C may be configured to operate in a recirculation mode, whereby a continuous flow of fluid through the head is established during use. For example, the resulting droplet deposition head may be provided with one or more fluid inlet ports and one or more fluid outlet ports for connection to a fluid supply system.

The resulting flow of fluid through the head may be continuous. More particularly, there may be established a continuous flow of fluid through each of the chambers 10 in the row. This flow may, depending on the configuration of the fluid supply system (e.g. the fluid pressures applied at the fluid inlet and fluid outlet), continue even during droplet ejection, albeit potentially at a lower flow rate.

In more detail, such a fluid supply system may, for instance, be configured to apply a positive pressure to the fluid at the fluid inlet port and a negative pressure to the fluid at the fluid outlet port, thereby drawing fluid through the head.

Regardless of the particular configuration of the fluid supply system, in a recirculation mode fluid may flow in parallel through each of the fluid inlet passageways 12, then (via the corresponding one of the flow restrictor passages 14*a*) through the corresponding one of the fluid chambers 10, past the respective one of the nozzles 18, and then through the corresponding one of the fluid outlet passageways 16 (via the corresponding one of the flow restrictor passages 14*b*).

It should further be appreciated that the actuator component 1 of FIGS. 1A-1C may be modified in a straightforward manner such that the outlet passageways 16 function as additional inlet passageways, with each chamber 10 thus being supplied with fluid by two respective inlet passageways. While the modifications to the actuator component that this would necessitate might be relatively minor, the other fluid supply components of the droplet deposition head, such as the manifold components, would in general differ more significantly, as compared with where the head was configured to operate in a recirculation mode.

Returning now to FIG. 1B, it is apparent from the drawing that each flow restrictor passage 14*a*, 14*b* presents a smaller cross-sectional area to flow as compared with the passages immediately adjacent to it. In the particular example shown, this is accomplished by each flow restrictor passage 14*a*, 14*b* having a smaller width perpendicular to the layering direction L as compared with the passages immediately adjacent to it. This approach to providing a reduced cross-section may be particularly appropriate as many techniques for forming patterned layers will provide greater control over features formed in the planes of the layers.

As is illustrated in FIG. 1A, in the particular design of an actuator component 1 of FIGS. 1A-1C each inlet passageway 12 extends through a number of layers within the actuator component 1, including: capping layer 40, wiring and passivation layers 30, membrane layer 20, and fluid chamber substrate layer 2. Similarly, each outlet passageway 16 extends through capping layer 40, wiring and passivation layers 30, membrane layer 20, and fluid chamber substrate layer 2.

Membrane layer 20 may therefore be considered as dividing each inlet passageway 12 into upper and lower portions (where the upper portion is that furthest from the nozzle layer 4 and the lower portion is that nearest to the nozzle layer 4) and each outlet passageway 16 into upper and lower respective portions (where, again, the upper portion 16 is that furthest from the nozzle layer 4 and the lower portion 16 is that nearest to the nozzle layer 4).

As is shown in FIG. 1A, in the particular design of an actuator component 1 of FIGS. 1A-10 each inlet passageway 12 is elongate in a direction that is generally parallel to the layering direction L. Similarly, each outlet passageway 16 is elongate in a direction generally parallel to the layering direction L.

However, this is not essential and in other designs the inlet and/or the outlet passageways could be elongate in other directions; for example, they may be elongate perpendicular to the layering direction (as will be described below with reference to FIGS. 7A-7C).

More generally, where the inlet and/or the outlet passageways are elongate in a direction that is perpendicular to the row direction R, it may be possible to provide a compact structure, since their extent in the row direction R is small, thereby enabling the chambers to be closely spaced in the row direction R also.

In some cases, the surfaces of various features of the actuator component 1 may be coated with protective or functional materials, such as, for example, a suitable passivation or wetting material. For instance, such materials may be applied to the surfaces of those features that contact fluid during use, such as the inner surfaces of the inlet passageways 12, the outlet passageways 16, the fluid chambers 10 and/or the nozzles 18.

The fluid chamber substrate layer 2 shown in FIGS. 1A-1C may be formed of silicon (Si), and may for example be manufactured from a silicon wafer, whilst the features provided in the fluidic chamber substrate 2, including the fluid chambers 10, lower portions of inlet passageways 12(*b*), lower portions of outlet passageways 16(*b*), and flow restrictor passages 14*a*, 14*b* may be formed using any suitable fabrication process, e.g. an etching process, such as deep reactive ion etching (DRIE) or chemical etching. In some cases, the features of the fluid chamber substrate layer 2 may be formed from an additive process e.g. a chemical vapour deposition (CVD) technique (for example, plasma enhanced CVD (PECVD)), atomic layer deposition (ALD), or the features may be formed using a combination of etching and/or additive processes.

The nozzle layer 4 may comprise, for example, a metal (e.g. electroplated Ni), a semiconductor (e.g. silicon) an alloy, (e.g. stainless steel), a glass (e.g. $SiO_2$), a resin material or a polymer material (e.g. polyimide, SU8). In some cases, the nozzle layer 4 may be formed of the same material(s) as the fluid chamber substrate layer 2. Moreover, in some cases the features of the nozzle layer, including the nozzles 18, may be provided by the fluid chamber substrate layer 2, with the nozzle layer and fluid chamber substrate layer 2 being in effect combined into a single layer.

The nozzle layer 4 may, for example, have a thickness of between 10 μm and 200 μm (though for some applications a thickness outside this range may be appropriate).

The nozzles 18 may be formed in the nozzle layer 4 using any suitable process such as chemical etching, DRIE, or laser ablation.

In the design illustrated in FIG. 1A, the nozzle 18 is tapered such that its diameter decreases from its inlet to its outlet. The diameter of the nozzle outlet may, for example, be between 15 μm and 100 μm (though in some applications a diameter outside this range may be appropriate).

The taper angle of the nozzle 18 may be substantially constant, as shown in FIG. 1A, or may vary between the inlet and the outlet. For instance, the nozzle 18 may have a greater taper angle at its inlet than at its outlet (or vice versa).

As noted above, each actuating element 22 is actuable to cause the ejection of fluid from the corresponding one of the chambers 10 through the corresponding one of the nozzles 18. In the particular example shown in FIGS. 1A-1C, each actuating element 22 functions by deforming membrane layer 20.

The membrane layer 20 may comprise any suitable material, such as, for example, a metal, an alloy, a dielectric material and/or a semiconductor material. Examples of suitable materials include silicon nitride ($Si_3N_4$), silicon dioxide ($SiO_2$), aluminium oxide ($Al_2O_3$), titanium dioxide ($TiO_2$), silicon (Si) or silicon carbide (SiC). The membrane layer 20 may be formed using any suitable technique, such as, for example, ALD, sputtering, electrochemical processes and/or a CVD technique. The apertures corresponding to the inlet and outlet passageways 12, 16 may be provided in the membrane 20 for example by forming an initial layer of material, in which apertures are then etched or cut to form the patterned membrane layer 20, or by forming the apertures (and, optionally, other patterning) simultaneously with the membrane layer 20 using a patterning/masking technique.

The membrane 20 may be any suitable thickness as required by an application, such as between 0.3 μm and 10 μm. The selection of a suitable thickness may balance, on the one hand, the drive voltage required to obtain a certain amount of deformation of the membrane (since, in general, a thicker and therefore more rigid membrane will require a greater drive voltage to achieve a specific amount of deformation) and, on the other hand, the reliability and performance parameters of the device (as thinner membranes may have shorter lifetimes, for example as they may be more susceptible to cracking).

While only one membrane layer is illustrated in FIGS. 1A-1C, it should be noted that multiple membrane layers could be employed in other designs. The various membrane layers might be formed from different materials, for example so as to provide the membrane with mechanical robustness to fatigue. In the simplest case, the membrane may have a bilayer construction, but any suitable number of layers of different materials could be employed.

The membrane layer 20 faces the nozzle layer 4, with droplets being ejected in a direction normal to the plane of the membrane layer 20, that is to say, in a direction parallel to the layering direction L.

Such actuation may occur in response to the application of a drive waveform to the actuating element 22. In the example shown in FIGS. 1A-1C, such drive waveforms are received by two respective electrodes for each actuating element 22.

In more detail, actuating element 22 shown in FIGS. 1A and 1B includes a piezoelectric member 24 a bottom electrode 26 and a top electrode 28.

The piezoelectric member 24 may, for example, comprise lead zirconate titanate (PZT), but any suitable piezoelectric material may be used.

The piezoelectric member 24 is generally planar, having opposing faces that extend normal to the layering direction L: the top electrode 28 is provided on one of these faces and the bottom electrode 26 is provided on the other. As may be seen from FIG. 1A, the bottom electrode 26 is disposed between the piezoelectric member 24 and the membrane layer 20, whereas the top electrode 28 overlies the piezoelectric member and faces towards a recess 42 defined within capping layer 40.

The capping layer 40 may define a single recess 42 for groups of, or all of the actuating elements, or may define a respective recess 42 for each actuating element 22. Such recesses 42 may be sealed in a fluid-tight manner so as to prevent fluid within the fluid chambers 10, inlet passageways 12 and outlet passageways 16 from entering.

The capping layer 40 shown in FIGS. 1A-1C may be formed of silicon (Si), and may for example be manufactured from a silicon wafer, whilst the features provided in the capping layer 40, including the recesses 42 and the upper portions of the inlet passageways 12 and of the outlet passageways 16 may be formed using any suitable fabrication process, e.g. an etching process, such as deep reactive ion etching (DRIE) or chemical etching. In some cases, at least a subset of features of the capping layer 40 may be formed from an additive process e.g. a CVD technique (for example, PECVD), ALD etc. In still other cases, the features may be formed using a combination of etching and/or additive processes.

The piezoelectric member 24 may be provided on the lower electrode 26 using any suitable fabrication technique. For example, a sol-gel deposition technique, sputtering and/or ALD may be used to deposit successive layers of piezoelectric material on the lower electrode 26 to form the piezoelectric element 24.

The lower electrode 26 and upper electrode 28 may comprise any suitable material, such as iridium (Ir), ruthenium (Ru), platinum (Pt), nickel (Ni) iridium oxide ($Ir_2O_3$), $Ir_2O_3$/Ir, aluminium (Al) and/or gold (Au). The lower electrode 26 and upper electrode 28 may be formed using any suitable techniques, such as, for example, a sputtering technique.

In order to provide drive waveforms to the actuating elements 22, the actuator component 1 includes a number of electrical traces 32*a*, 32*b*. Such traces electrically connect the upper 28 and/or lower 26 electrodes to drive circuitry (not shown) and may, for example, extend in a plane having a normal in the layering direction L.

In the actuator component 1 of FIGS. 1A-1C, these traces are provided as part of the wiring and passivation layers 30 and are provided on the membrane layer 20. However, in other designs the traces may be provided on other layers within an actuator component.

In the particular design illustrated in FIG. 1A, the upper electrodes 28 are electrically connected to electrical traces 32*a*, whereas the lower electrodes 26 are electrically connected to electrical traces 32*b*.

The electrical traces 32*a*/32*b* may, for example, have a thickness of between 0.01 μm and 10 μm, preferably between 0.1 μm and 2 μm, more preferably between 0.3 μm and 0.7 μm.

The electrical traces 32*a*/32*b* may be formed of any suitable conductive material, such as copper (Cu), gold (Ag), platinum (Pt), iridium (Ir), aluminium (Al), or titanium nitride (TiN).

At least one passivation layer 33*b* electrically isolates the traces 32*b* for the lower electrodes 26 from the traces 32*a* for the upper electrodes 28. At least one additional passivation layer 33*a* extends over the traces 32*a* for the upper electrodes 28 and may also extend over traces 32*b* for the lower electrodes 26.

Such passivation layers may protect the electrical traces 32*a*/32*b* from the environment to reduce oxidation of the electrical trace. In addition, or instead, they may protect the electrical traces 32*a*/32*b* from the droplet fluid during operation of the head, as contact between the traces and the fluid might cause short-circuiting to occur and/or may degrade the traces.

The passivation layers 33*a*/33*b* may comprise dielectric material so as to assist in electrically insulating the traces 32*a*/32*b* from each other.

The passivation layers 33*a*/33*b* may comprise any suitable material, such as $SiO_2$, $Al_2O_3$, $Zr0_2$, SiN, $HfO_2$.

Depending on the particular configuration of the traces 32*a*/32*b* and the passivation layers 33*a*/33*b*, the wiring and passivation layers 30 may further include electrical connections, such as electrical vias (not shown), to electrically connect the electrical traces 32*a*/32*b* with the electrodes 26/28 through the passivation layers 33*a*/33*b*.

The wiring and passivation layers 30 may also include adhesion materials (not shown) to provide improved bonding between, for example, any of: the electrical traces 32*a*/32*b*, the passivation layers 33*a*/33*b*, the electrodes 26, 28 and the membrane 20.

The wiring and passivation layers 30 (e.g. the electrical traces/passivation material/adhesion material etc.) may be provided using any suitable fabrication technique such as, for example, a deposition/machining technique, e.g. sputtering, CVD, PECVD, ALD, laser ablation etc. Furthermore, any suitable patterning technique may be used as required, such as photolithographic techniques (e.g. providing a mask during sputtering and/or etching).

Reference is now directed to FIG. 10, which is a plan view of the actuator component 1 from the side to which the capping layer 40 is attached, with the capping layer 40 removed so as to show clearly an illustrative configuration of the electrical traces 32 on membrane layer 20. In the illustrative configuration shown in FIG. 10, each actuating element 22 is electrically connected to two traces 32. In FIG. 10, the fluid chambers 10, flow restrictor passages 14*a*, 14*b* and nozzles 18, which are located on the far side of the membrane 20 in the view of FIG. 10, are depicted with dashed lines so as show clearly their orientations relative to the traces 32, inlet and outlet passageways 12,16 and the actuating elements 22.

As may be seen from FIG. 10, the traces 32 extend in a plane having a normal in the layering direction L. As is apparent from a comparison of FIG. 1A with FIG. 10, the inlet passageways 12 cross this plane, with each inlet passageway 12 passing between conductive traces 32. As FIG. 10 shows, one trace passes between each pair of neighbouring inlet passageways 12 (as the trace in question passes from one side of the row of inlet passageways 12 to the other). The outlet passageways 16 likewise cross this plane, with each outlet passageway 16 passing between conductive traces. As FIG. 10 shows, one trace 32 passes between each pair of neighbouring outlet passageways 16 (as the trace in question passes from one side of the row of outlet passageways 16 to the other).

The actuator component 1 shown in FIGS. 1A-1C may, for example, be fabricated using processes typically used to fabricate structures for Micro-Electro-Mechanical Systems (MEMS). In such cases, the actuator component 1 may be described as being a MEMS actuator component (it being noted that this carries with it no implication as to the type of actuating element utilised: for instance, actuator components with thermal actuating elements are referred to within the art as MEMS actuator components regardless of the fact that they do not include electromechanical actuating elements).

Figure 1D:
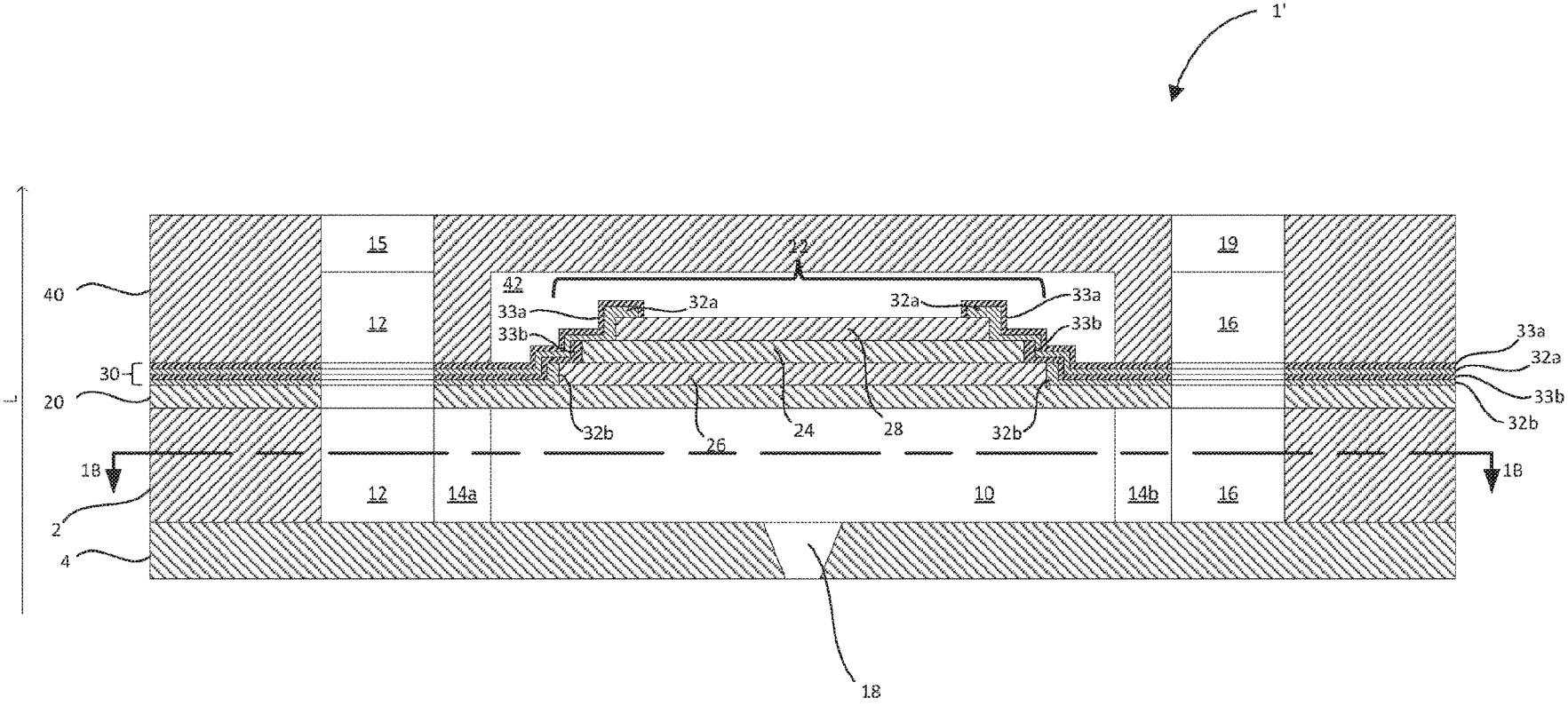
FIG. 1D is a plan view of a cross-section taken along the length of a fluid chamber of a modified version of the actuator component shown in FIG. 1A.

FIG. 1D illustrates a modified version 1' of the actuator component 1 shown in FIGS. 1A-1C. More particularly, FIG. 1D is a plan view of a cross-section taken along the length of one of the chambers 10 of the modified actuator component 1'. As is apparent from a comparison of FIG. 1D with FIG. 1A, the fluidic architecture of the actuator component 1 of FIGS. 1A-1C has been modified.

In more detail, in the actuator component 1 of FIGS. 1A-1C, an end of each of the inlet passageways 12 opens to the exterior of the actuator component 1. Thus, each inlet passageway 12 may receive fluid from exterior the actuator component, for example from a manifold component attached to the actuator component that forms part of the droplet deposition head, and convey it towards the fluid chambers 10. An end of each of the outlet passageways 16 similarly opens to the exterior of the actuator component 1. Thus, each outlet passageway 16 may convey fluid that it has received from the chambers 10 to exterior the actuator component, for example to the same (or an additional) manifold component attached to the actuator component 1 that forms part of the droplet deposition head.

In contrast, in the actuator component 1' shown in FIG. 1D, there is formed an inlet port 15 that is fluidically connected at a first end to the exterior of the layers of the actuator component 1', so as to receive fluid therefrom, and at a second end to each of the inlet passageways 12 within the row. The inlet port 15 is therefore elongate in the row direction R (into the page in FIG. 1D).

As may also be seen from FIG. 1D, there is formed in the actuator component 1' an outlet port 19 that is fluidically connected at a first end to each of the outlet passageways 16 within the row, so as to receive fluid therefrom, and at a second end to the exterior of the layers of the actuator component 1', so as to supply fluid thereto. The outlet port 19 is likewise elongate in the row direction R (into the page in FIG. 1D).

While in the particular design shown in FIG. 1D, the inlet port 15 and the outlet port 19 are formed in the capping layer 40, they could be formed in any suitable layer. For instance, an additional layer could be provided that overlies the capping layer 40, with the inlet port 15 and the outlet port 19 being provided substantially within this additional layer.

Further, while FIG. 1D illustrates the inlet port 15 and the outlet port 19 as extending only part-way into the capping layer 40 in the layering direction L, in other example embodiments either or both of the inlet port 15 and the outlet port 19 could extend through the entirety of the capping layer 40, for example all the way to the membrane layer 20.

While only one inlet port 15 is provided in the actuator component 1' shown in FIG. 1D, with this inlet port 15 being common to all the inlet passageways 12, in other designs a number of inlet ports 15 could be provided, with each being connected to a corresponding group of inlet passageways 12 so as to supply fluid thereto.

In addition or instead, a number of outlet ports 19 could be provided (rather than just one common outlet port 19, as in FIG. 1D) with each being connected to corresponding group of outlet passageways 16, so as to receive fluid therefrom.

Figure 2:
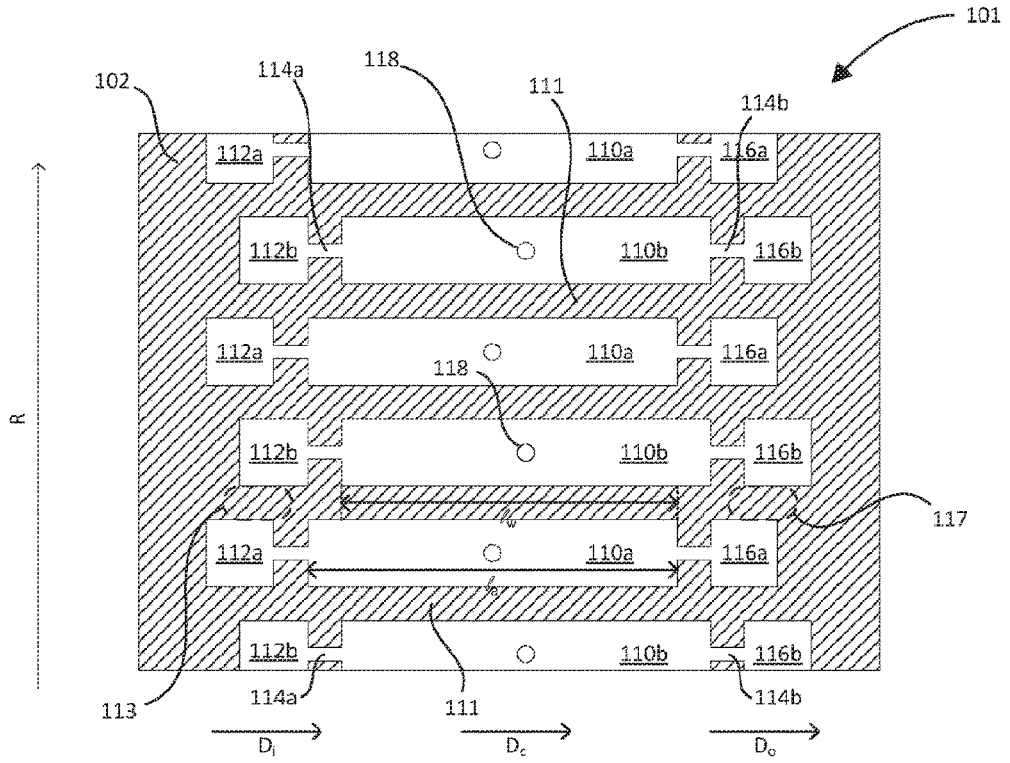
FIG. 2 is a cross-section taken through an actuator component of a droplet deposition head according to a first example embodiment, with staggered rows of inlet passageways, outlet passageways and fluid chambers.

FIG. 2 is a cross-section taken through an actuator component 101 of a droplet deposition head according to a first example embodiment. The actuator component of the first example embodiment is a modification of the initial design of an actuator component detailed above with reference to FIGS. 1A-1C. Accordingly, the actuator component 101 of the first example embodiment should be understood as having generally the same structure and functionality as the actuator component 1 of the initial design shown in FIGS. 1A-1C, except where stated below. Like features are indicated using the same reference numerals as FIGS. 1A-1C, but with an increment of 100.

The actuator component 101 of the first example embodiment includes a plurality of patterned layers that are stacked in a layering direction L, which extends into the page in FIG. 2. A row of fluid chambers 110, a row of inlet passageways 112 and a row of outlet passageways 116 are formed within the layers of the actuator component 101, with each of these rows extending in row direction R, which is perpendicular to the layering direction L.

The cross-section of FIG. 2 is taken through the fluid chamber substrate layer 202 of the actuator component 101 and shows the relative locations of fluid chambers 110, inlet passageways 112, and outlet passageways 116.

As may be seen from the drawing, the row of inlet passageways 112 is staggered, with a number of the inlet passageways 112 being offset from their neighbours in an inlet passageway offset direction $D_i$. The row of outlet passageways 116 is similarly staggered, with a number of the outlet passageways 116 being offset from their neighbours in an outlet passageway offset direction $D_o$.

The row of fluid chambers 110 is also staggered, with a number of the fluid chambers 110 being offset from their neighbours in a chamber offset direction $D_c$.

It may further be noted that in the example embodiment of FIG. 2 all of the fluid chambers 110 have substantially the same shape and that the position of each nozzle 118 with respect to its corresponding chamber 110 is substantially the same for all chambers. As is apparent from FIG. 2, this may, in certain embodiments, result in the corresponding row of nozzles 118 being staggered in substantially the same manner as the row of fluid chambers 110. For instance, as is shown in FIG. 2, the offset direction for the row of nozzles 118 may be the same as the offset direction $D_c$ for the row of fluid chambers 110. As is also apparent from FIG. 2, the offset direction for the row of nozzles 118 is perpendicular to the direction in which the nozzles eject droplets (into the page in FIG. 2).

Considering now the arrangement of the inlet passageways 112 in FIG. 2, it is apparent that the inlet passageways 112 are assigned alternately to group "a" (such passageways being indicated in the drawing by 112*a*) and to group "b" (such passageways being indicated in the drawing by 112*b*), with inlet passageways within a particular group 112*a*, 112*b* being aligned in the inlet passageway offset direction D.

As may also be seen from FIG. 2, the outlet passageways 116 are assigned to the same groups "a" and "b", as are the fluid chambers 110 (with membership of a group being indicated by the suffix "a" or "b"). Outlet passageways within a particular group 116*a*, 116*b* are aligned in the outlet passageway offset direction $D_o$. As may also be seen from the drawing, inlet passageways 212 and outlet passageways 216 corresponding to the same chamber 210 are assigned to the same one of groups "a" and "b".

Similarly to the actuator component 1 of FIGS. 1A-1C, each inlet passageway 112 is elongate in a direction that is generally parallel to the layering direction L, as is each outlet passageway 116. As may be seen from FIG. 2, the inlet passageway offset direction $D_i$ is perpendicular to the length direction of each inlet passageway 112. Consequently, the inlet passageway offset direction $D_i$ in FIG. 2 is perpendicular to both the row direction R and the layering direction L.

The outlet passageway offset direction $D_o$ is similarly perpendicular to the length direction of each outlet passageway 116. Consequently, the outlet passageway offset direction $D_o$ in FIG. 2 is perpendicular to both the row direction R and the layering direction L.

A further similarity with the actuator component of FIGS. 1A-1C is that each inlet passageway 112 is fluidically connected so as to supply fluid to a respective one of the row of fluid chambers 110. Conversely, each outlet passageway 116 is fluidically connected so as to receive fluid from a respective one of the row of fluid chambers 110.

Further, an end of each of the inlet passageways 112 may open to the exterior of the actuator component 101, so that the inlet passageway 112 in question may receive fluid from exterior the actuator component (e.g. from a manifold component attached to the actuator component 101 that forms part of the droplet deposition head), and convey it towards the fluid chambers 110. An end of each of the outlet passageways 116 may similarly open to the exterior of the actuator component 101 so that the outlet passageway 116 in question may convey fluid that it has received from the chambers 110 to exterior the actuator component 101 (e.g. to the same or an additional manifold component attached to the actuator component 101 that forms part of the droplet deposition head).

Alternatively, the actuator component 101 may include inlet and outlet ports, as described above with reference to FIG. 1D with these respectively receiving fluid from and conveying fluid to the exterior of the actuator component 101. Such inlet and outlet ports may have sufficient width perpendicular to the row direction R (and to layering direction L) to account for the staggering of the inlet passageways 112 and outlet passageways 116, or may be shaped so as correspond to the staggering of the inlet passageways 112 and outlet passageways 116, for example having a zig-zag or serpentine shape.

As discussed above with reference to FIGS. 1A-1C, when the actuating elements are driven, pressure waves are generated within the chambers 110 that cause the ejection of droplets from the nozzles 118. Residual pressure waves within the fluid within the chambers 110 being actuated may be conveyed along the corresponding inlet passageways 112 and outlet passageways 116 away from the chambers 110. Thus, the inlet passageways 112 and outlet passageways 116 may act to guide the residual energy away from the chambers 110 being actuated.

The Applicant has carried out computational modelling on alternative actuator component designs that have a manifold chamber in close proximity to the chambers 110. Such modelling indicates pressure waves within the droplet fluid can transfer significant amounts of energy from an actuated chamber to its neighbours. This transferred energy may interfere with droplet ejection from the neighbouring chambers, in a process known as "crosstalk". Such crosstalk may, for example, result in greater variability of the velocity (in terms of magnitude and/or direction) and/or the volume of the droplets ejected by the head, owing to such interference between neighbouring chambers.

In contrast, such modelling indicates that actuator component designs such as that shown in FIG. 2, which have individual inlet and/or outlet passageways 112/116 for each chamber that may guide the residual energy away from the chambers 110 being actuated, may experience less interference or crosstalk between neighbouring chambers. This is found to be particularly the case where the length of each inlet and/or outlet passageway 112/116 is at least 100 μm, with further benefit potentially being provided where the length of each inlet and/or outlet passageway 112/116 is at least 200 μm.

However, such modelling also indicates that the actuator component 1 illustrated in FIGS. 1A-1C may experience a transfer of significant amounts of energy from pressure waves within an inlet (or outlet) passageway (which originate from pressure waves within the fluid chamber) to a neighbouring inlet (or outlet) passageway, by means of lateral movement of the wall 13, 17 dividing those passageways. Such lateral movement of the dividing wall 13, 17 generates pressure waves in the fluid within the neighbouring inlet (or outlet) passageway, which may then be transferred to the fluid chamber to which it is connected. As a result, crosstalk remains an issue to some extent in the actuator component design illustrated in FIGS. 1A-1C.

One approach to addressing this issue is to increase the spacing of the chambers and inlet/outlet passageways in the row direction R. However, this necessarily results in a lower resolution for the actuator component (other things being equal).

The actuator component of FIG. 2 addresses the crosstalk issues in a different manner. Specifically, by staggering the rows of inlet and outlet passageways 112, 116, there is less overlap between neighbouring inlet passageways and neighbouring outlet passageways, which results in structural vibrations within the actuator component meeting significantly greater resistance when travelling through the walls 113, 117 between neighbouring passageways. Put differently, the walls 113, 117 are structurally stiffer.

Further, if the area of overlap between neighbouring inlet passageways 112 or outlet passageways 116 when they are viewed from the row direction R is considered, it should be appreciated that this is particularly small in the example embodiment of FIG. 2. This is a result of the inlet passageway offset direction $D_i$ being perpendicular to the length direction of each inlet passageway 112 and, similarly, the outlet passageway offset direction $D_o$ being perpendicular to the length direction of each outlet passageway 116. Thus, when the offset direction is perpendicular to the length direction of the inlet or outlet passageways, even a small amount of offset results in a significant decrease in the area of overlap, viewed from the row direction, between neighbouring chambers. A possible consequence is that the shielding of one passageway 112/116 from vibrations in its neighbour is particularly effective.

Furthermore, the reduction of crosstalk provided by the example embodiment of FIG. 2 has been demonstrated experimentally. Specifically, when actuator components manufactured to designs generally as illustrated in FIGS. 1A-1C and in FIG. 2 were tested, the latter was found to experience an order of magnitude less variability in the velocity of ejected droplets. Specifically, each actuator component was operated such that a particular chamber was actuated, firstly, to eject a droplet when one of its two neighbouring chambers simultaneously ejects a droplet and, secondly, to eject a droplet when neither of the neighbouring chambers simultaneously ejects a droplet. The velocities of the droplets ejected by the particular chamber in the two cases were then compared, so as to provide a measure of the crosstalk between the particular chamber and its neighbouring chambers.

With the actuator component manufactured to a design generally as illustrated in FIGS. 1A-1C, a 2.6% change in velocity was experienced when the neighbouring chamber was actuated. By contrast, with the actuator component manufactured to a design generally as illustrated in FIG. 2, the change was only 0.23%, indicating an order of magnitude reduction in cross-talk.

As noted above, in the example embodiment of FIG. 2, the row of fluid chambers 110 is staggered. This reduces the portion $I_w$ of the length of the wall 111 where neighbouring chambers 110 overlap. Moreover, in embodiments such as that shown in FIG. 2, where the offset direction $D_c$ for the row of fluid chambers 110 is the same as the direction in which each chamber is elongated, this portion $I_w$ of the length of the wall 111 where neighbouring chambers 110 overlap is, in consequence, less than the length of the chambers 110. More particularly, the length $I_w$ of the overlap portion of the wall 111 may be less than the acoustic length $I_a$ of the chambers 110. Accordingly, this may contribute to reducing crosstalk in the actuator component 101.

Furthermore, the overlap portion $I_w$ of the wall 111 is not aligned with the centre of the neighbouring chamber 110. In many cases, the fundamental mode of vibration of the wall of a chamber will be at or near the centre of the chamber. Accordingly, a possible consequence of the overlap portion $I_w$ of the wall 111 not being aligned with the centre of the neighbouring chamber is that vibrations are less efficiently transferred from one chamber 110 through this overlap portion of the wall 111 to its neighbour and/or have less effect on ejection where they are transferred. Accordingly, this may contribute to reducing crosstalk in the actuator component 101.

As noted above, in the example embodiment of FIG. 2, the row of nozzles 118 is staggered. In droplet deposition heads that include actuator components such as that shown in FIG. 2, where the row of nozzles is staggered, it is envisaged that the actuation of fluid chambers 110 belonging to different groups may take place at different times: there may be a temporal offset of the actuation of different groups. This may, for example, result in the droplets ejected by the different groups of chambers 110*a*, 110*b* forming dots disposed on a single line on the substrate, despite the staggering of the row of nozzles 118. A possible consequence of this temporal offset is that vibrations created in neighbouring chambers are less likely to constructively interfere, whether such vibrations are within the wall separating the fluid chambers 111, within the walls separating the inlet or outlet passageways 113, 117 or within fluid in the manifold adjacent the ends of the inlet and outlet passageways 112, 116. Accordingly, this may contribute to reducing crosstalk in the actuator component 101.

Figure 3:
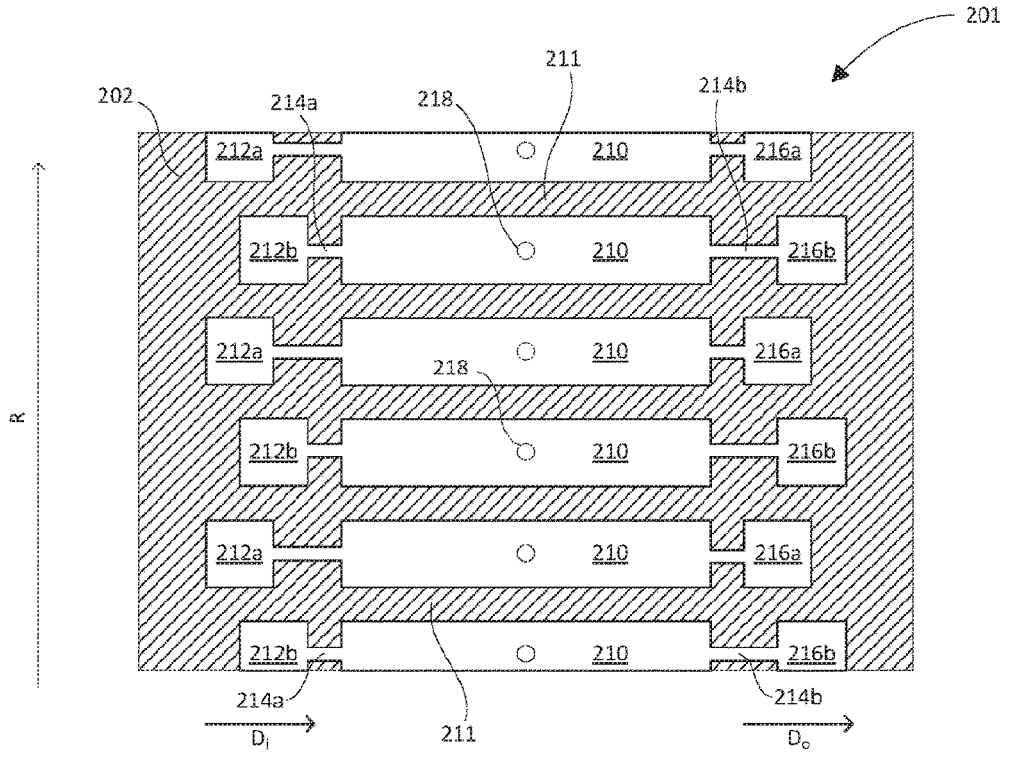
FIG. 3 is a cross-section taken through an actuator component of a droplet deposition head according to a further example embodiment, where the row of fluid chambers is aligned.

Although in the example embodiment of FIG. 2, in addition to the rows of inlet and outlet passageways 112, 116 being staggered, the row of fluid chambers 110 is also staggered, this is by no means essential (especially as staggering the row of fluid chambers may in some cases have a less significant impact upon crosstalk) and in other embodiments the fluid chambers may, in contrast, be aligned. FIG. 3 illustrates in a similar manner to FIG. 2 an actuator component 201 according to such an embodiment. In FIG. 3, the same reference numerals are used as in FIGS. 1A-1C, but with an increment of 200.

The actuator component 201 of FIG. 3 includes a staggered row of inlet passageways 212 and a staggered row of outlet passageways 216, but a linearly-aligned row of fluid chambers 210; specifically, the fluid chambers 210 are aligned along a line extending in the row direction R. The nozzles 218 for the chambers 210 are likewise aligned along a line extending in the row direction R.

As in the example embodiment of FIG. 2, the inlet passageways 212 are assigned alternately to group "a" (such passageways being indicated in the drawing by 212*a*) and to group "b" (such passageways being indicated in the drawing by 212*b*), with inlet passageways within a particular group 212*a*, 212*b* being aligned in the inlet passageway offset direction $D_i$. Similarly, the outlet passageways 216 are assigned to the same groups "a" and "b" (with membership of a group being indicated by the suffix "a" or "b", as before), with outlet passageways within a particular group 216*a*, 216*b* being aligned in the outlet passageway offset direction $D_o$. Inlet passageways 212 and outlet passageways 216 corresponding to the same chamber 210 are assigned to the same one of groups "a" and "b".

As is apparent from the drawing, as a result of the alignment of the row of fluid chambers 210 (in contrast to the example embodiment of FIG. 2) and the staggering of the rows of inlet passageways 212 and outlet passageways 216, the flow restrictor passages 214 for adjacent passageways are not of equal length. However, other characteristics of the flow restrictor passages 214 are varied so that the flow restrictor passages 214 nonetheless provide the same resistance and inertance. For example, their cross-sectional areas may be varied e.g. by altering their widths and/or heights.

As discussed above with reference to FIG. 2, an end of each of the inlet passageways 212 and outlet passageways 216 may open to the exterior of the actuator component 201, so as to respectively receive fluid from and convey fluid to exterior the actuator component. Alternatively, the actuator component 201 may include inlet and outlet ports, as described above with reference to FIG. 1D with these respectively receiving fluid from and conveying fluid to the exterior of the actuator component 201. As before, such inlet and outlet ports may have sufficient width perpendicular to the row direction R (and to layering direction L) to account for the staggering of the rows of inlet passageways 212 and outlet passageways 216, or may be shaped so as correspond to the staggering of the rows of inlet passageways 212 and outlet passageways 216, for example having a zig-zag or serpentine shape.

While in the example embodiment of FIG. 3 the chambers 210 and nozzles 218 are illustrated as being aligned in like manner, in other embodiments the row of nozzles could be staggered, with the row of chambers being aligned.

Figure 4:
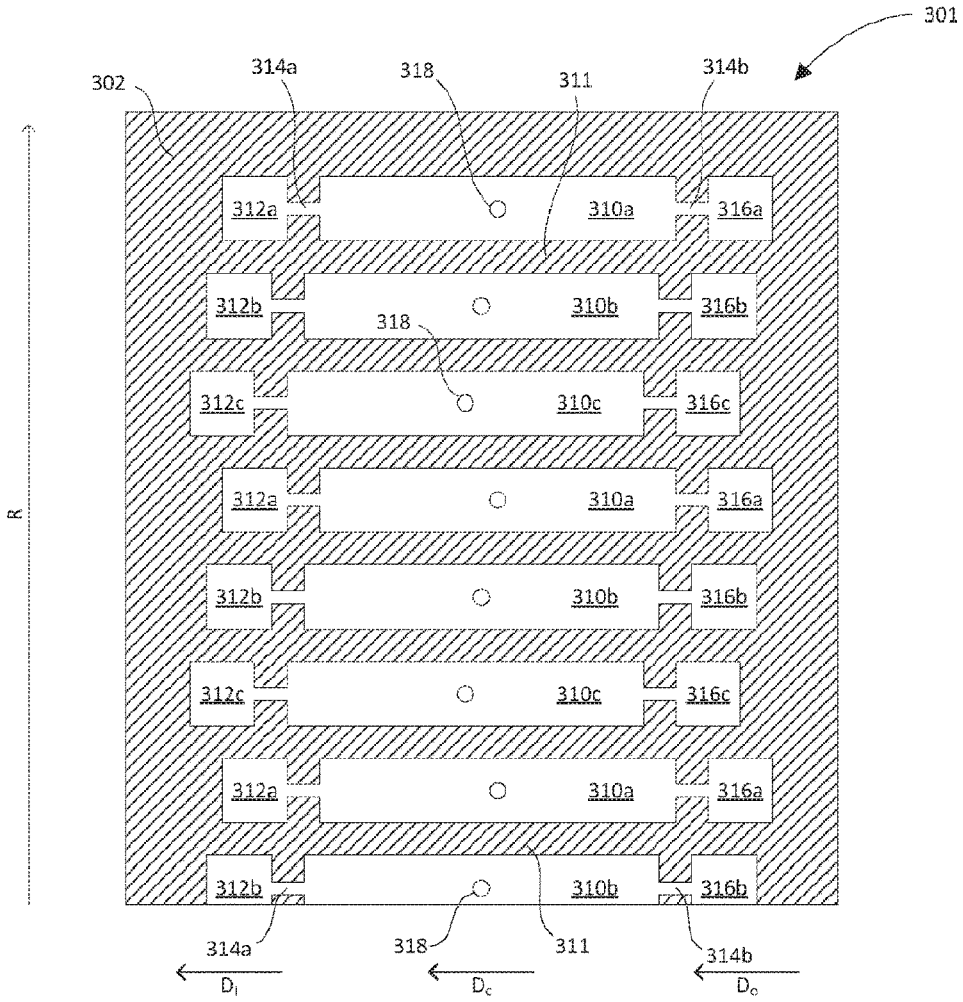
FIG. 4 is a cross-section taken through an actuator component of a droplet deposition head according to a still further example embodiment, with staggered rows of inlet passageways, outlet passageways and fluid chambers and in which inlet passageways, outlet passageways and fluid chambers are assigned to three groups.

While in the example embodiments of FIGS. 2 and 3 the inlet passageways 112, 212 and outlet passageways 116, 216 are assigned to only two groups, in other embodiments any suitable number of groups may be utilised. FIG. 4 illustrates in a similar manner to FIGS. 2 and 3 an actuator component 301 according to such an embodiment, in which three groups are utilised. In FIG. 4, the same reference numerals are used as in FIGS. 1A-1C, but with an increment of 300.

As may be seen from the drawing, the respective rows of inlet passageways 312, outlet passageways 316, and fluid chambers 310 are all staggered.

As may also be seen from FIG. 4, all of the fluid chambers 310 have substantially the same shape, that the position of each nozzle 318 with respect to its corresponding chamber 310 is substantially the same for all chambers. As is also apparent from FIG. 4, the row of nozzles 318 is staggered in substantially the same manner as the row of fluid chambers 310, having the same offset direction as the row of fluid chambers 310 (namely, chamber offset direction $D_c$).

Members of all these three staggered rows are assigned to the same three groups, namely, group "a", group "b", and group "c", according to a repeating pattern, with the inlet passageway 312 and outlet passageway 316 corresponding to the same chamber 310 being assigned to the same one of these three groups. More particularly, the repeating pattern is a cyclical assignment to group "a", then group "b", then group "c". The inlet passageway offset direction $D_i$, outlet passageway offset direction $D_o$, and chamber offset direction $D_c$ are all the same, as shown in the drawing.

As discussed above with reference to FIGS. 2 and 3, an end of each of the inlet passageways 312 and outlet passageways 316 may open to the exterior of the actuator component 301, so as to respectively receive fluid from and convey fluid to exterior the actuator component. Alternatively, the actuator component 301 may include inlet and outlet ports, as described above with reference to FIG. 1D with these respectively receiving fluid from and conveying fluid to the exterior of the actuator component 301. As before, such inlet and outlet ports may have sufficient width perpendicular to the row direction R (and to layering direction L) to account for the staggering of the rows of inlet passageways 312 and outlet passageways 316, or may be shaped so as correspond to the staggering of the rows of inlet passageways 312 and outlet passageways 316, for example having a zig-zag or serpentine shape.

Figure 5:
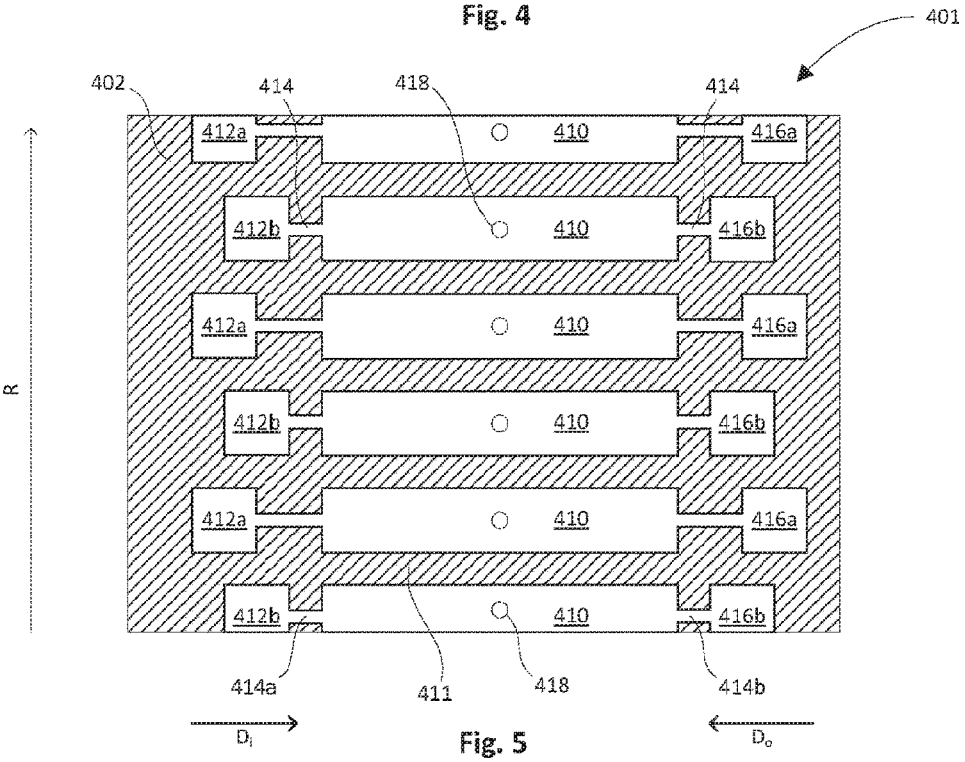
FIG. 5 is a cross-section taken through an actuator component of a droplet deposition head according to yet another example embodiment, where the offset direction for the row of inlet passageways is opposite to the offset direction for the row of outlet passageways.

While in each of the embodiments of FIGS. 2-4 the offset directions for all the staggered rows are the same, this is not essential. This is demonstrated in the example embodiment of FIG. 5, which is generally similar to the example embodiment of FIG. 3, having staggered rows of inlet passageways 412 and of outlet passageways 416 and a linearly-aligned row of fluid chambers 410. In FIG. 5, the same reference numerals are used as in FIGS. 1A-1C, but with an increment of 400.

From a consideration of FIG. 5, which is a plan view of a cross-section in plane through fluid chamber substrate layer 402, it is apparent that, as with the example embodiment of FIG. 3, there is provided a staggered row of inlet passageways 412 and a staggered row of outlet passageways 416, but a linearly-aligned row of fluid chambers 410 (the fluid chambers 410 being aligned along a line extending in the row direction R). The nozzles 418 for the chambers 410 are likewise aligned along a line extending in the row direction R.

As in the example embodiment of FIGS. 2-3, the inlet passageways 412 are assigned alternately to group "a" (such passageways being indicated in the drawing by 412*a*) and to group "b" (such passageways being indicated in the drawing by 412*b*), with inlet passageways within a particular group 412*a*, 412*b* being aligned in the inlet passageway offset direction $D_i$. Similarly, the outlet passageways 416 are assigned to the same groups "a" and "b" (with membership of a group being indicated by the suffix "a" or "b", as before), with outlet passageways within a particular group 416*a*, 416*b* being aligned in the outlet passageway offset direction $D_0$. Inlet passageways 412 and outlet passageways 416 corresponding to the same chamber 410 are assigned to the same one of groups "a" and "b".

However, in contrast to the example embodiment of FIG. 3, the inlet passageway offset direction $D_i$ in FIGS. 5A and 5B is opposite to the outlet passageway offset direction $D_o$. Thus, the arrangement of the inlet passageways 412 is essentially symmetric with the arrangement of the outlet passageways 416 about an axis extending in the row direction R.

As is apparent from the drawing, as a result of the alignment of the row of fluid chambers 410 (in contrast to the example embodiment of FIG. 2) and the staggering of the rows of inlet passageways 412 and outlet passageways 416, the flow restrictor passages 414 for adjacent passageways are not of equal length. However, in order that all flow restrictor passages provide the same resistance and inertance other characteristics of the flow restrictor passages 414 are varied, such as their cross-sectional areas (e.g. by altering their widths and/or heights).

As discussed above with reference to FIGS. 2 to 4, an end of each of the inlet passageways 412 and outlet passageways 416 may open to the exterior of the actuator component 401, so as to respectively receive fluid from and convey fluid to exterior the actuator component. Alternatively, the actuator component 401 may include inlet and outlet ports, as described above with reference to FIG. 1D with these respectively receiving fluid from and conveying fluid to the exterior of the actuator component 401. As before, such inlet and outlet ports may have sufficient width perpendicular to the row direction R (and to layering direction L) to account for the staggering of the rows of inlet passageways 412 and outlet passageways 416, or may be shaped so as correspond to the staggering of the rows of the inlet passageways 412 and outlet passageways 416, for example having a zig-zag or serpentine shape.

While in the example embodiment of FIG. 5 the chambers 410 and nozzles 418 are illustrated as being aligned in like manner, in other embodiments the row of nozzles could be staggered, with the row of chambers being aligned.

Figure 6A:
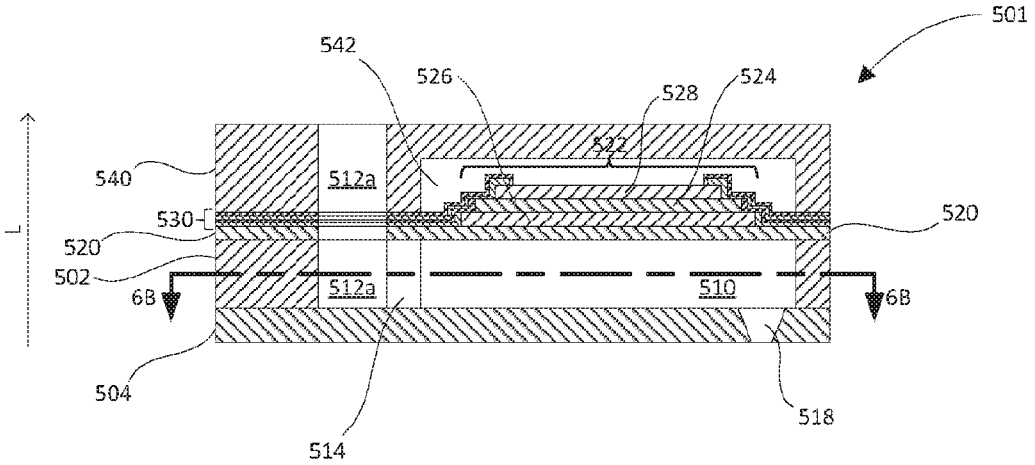
FIG. 6A is a plan view of a cross-section taken along the length of a fluid chamber of an actuator component according to a still further example embodiment, where each chamber is provided with only an inlet passageway.
Figure 6B:
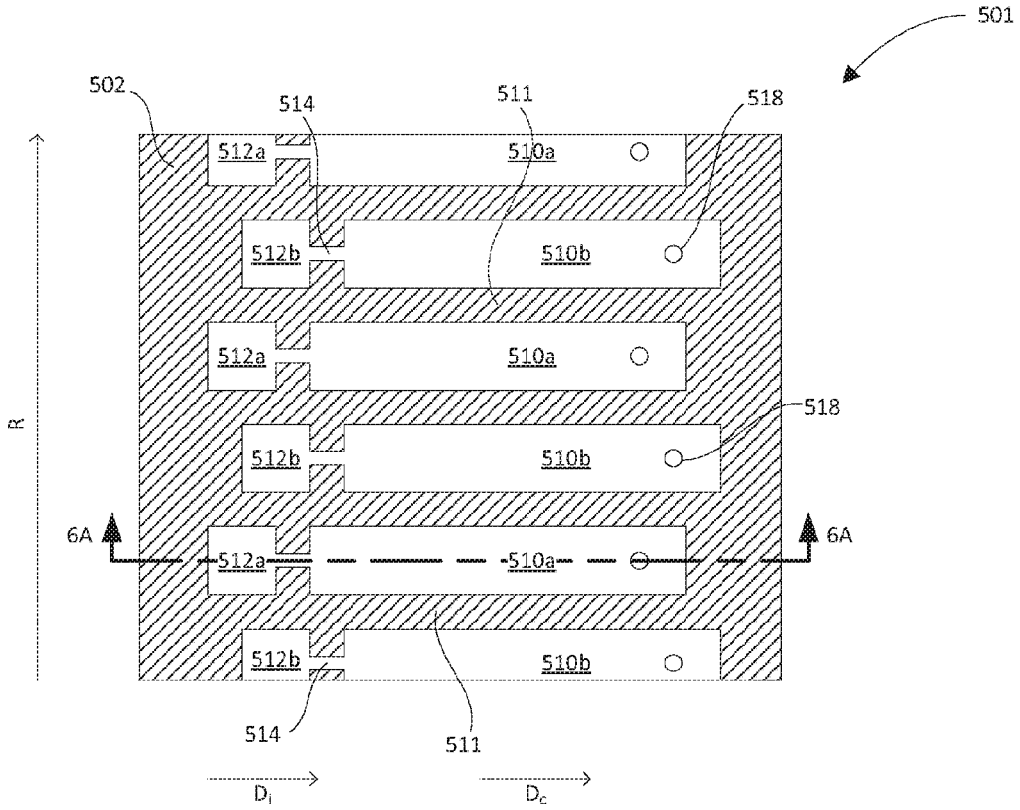
FIG. 6B is a cross-section taken in the plane in which the fluid chambers are formed through the actuator component of FIG. 6A.

While in the example embodiments of FIGS. 2-5 there is both an inlet passageway and an outlet passageway for each chamber (for example to enable the actuator components to be incorporated in a droplet deposition head configured for use in a recirculation mode), this is by no means essential. In other embodiments, there may only be an inlet passageway for each chamber (and not an outlet passageway). FIG. 6A illustrates in a similar manner to FIGS. 1A and 5A an actuator component 501 according to such an embodiment. In FIGS. 6A and 6B, the same reference numerals are used as in FIGS. 1A-1C, but with an increment of 500.

As may be seen from FIG. 6A, the actuator component 501 includes a number of patterned layers that are stacked in layering direction L, with each layer extending in a plane perpendicular to this layering direction L.

In the particular actuator component 501 shown in FIG. 6A, the patterned layers include nozzle layer 504, fluid chamber substrate layer 502, membrane layer 520, wiring and passivation layers 530, and capping layer 540 (in that order).

As may be seen from FIG. 6B, which is a cross-section taken in plane 6B indicated in FIG. 6A through fluid chamber substrate layer 502, a row of fluid chambers 510 and a row of inlet passageways 512 is formed within the layers of the actuator component 501, with these rows extending in a row direction R, which is substantially perpendicular to the layering direction.

As shown in FIG. 6A, each inlet passageway 512 is fluidically connected so as to supply fluid to one end of a respective one of the row of fluid chambers 510. Specifically, each inlet passageway 512 supplies fluid to the end in question of the corresponding fluid chamber 510 via a respective flow restrictor passage 514. A nozzle for the chamber 518 is located near the opposing end of the chamber 510. In the particular arrangement shown in FIG. 6A, the chamber 510 is elongate with the nozzle being located near one longitudinal end and the inlet passageway being fluidically connected to the opposite longitudinal end.

As also shown in FIG. 6A, each inlet passageway 512 is elongate in the layering direction L. In the example embodiment shown in the drawing, the inlet passageway 512 extends through the membrane layer 520 and through wiring and passivation layer 530.

As may be seen from FIG. 6B, both the row of fluid chambers 510 and the row of inlet passageways 512 are staggered: a number of the fluid chambers 510 are offset from their neighbours in a chamber offset direction $D_c$ whereas a number of the inlet passageways 512 are offset from their neighbours in an inlet passageway offset direction $D_i$.

As is apparent from FIG. 6B, all of the fluid chambers 510 have substantially the same shape, that the position of each nozzle 518 with respect to its corresponding chamber 510 is substantially the same for all chambers. As is also apparent from FIG. 6B, the row of nozzles 518 is staggered in substantially the same manner as the row of fluid chambers 510, having the same offset direction as the row of fluid chambers 510 (namely, chamber offset direction $D_c$).

As in the example embodiments of FIGS. 2, 3 and 5 the inlet passageways 512 are assigned alternately to group "a" (such passageways being indicated in the drawing by 512*a*) and to group "b" (such passageways being indicated in the drawing by 512*b*), with inlet passageways within a particular group 512*a*, 512*b* being aligned in the inlet passageway offset direction $D_i$. Similarly, the fluid chambers 510 are assigned to the same groups "a" and "b" (with membership of a group being indicated by the suffix "a" or "b", as before). Specifically, each fluid chamber 510 is assigned to the same one of groups "a" and "b" as its corresponding inlet passageway 512.

As discussed above with reference to FIGS. 2 to 5, an end of each of the inlet passageways 512 may open to the exterior of the actuator component 501, so as to receive fluid from exterior the actuator component. Alternatively, the actuator component 501 may include one or more inlet ports, as described above with reference to FIG. 1D, with these receiving fluid from the exterior of the actuator component 501. As before, such inlet ports may have sufficient width perpendicular to the row direction R (and to layering direction L) to account for the staggering of the row of inlet passageways 412, or may be shaped so as correspond to the staggering of the row of the inlet passageways 412, for example having a zig-zag or serpentine shape.

While in the example embodiments of FIGS. 2-6 the offset directions for the staggered rows are perpendicular to the layering direction L, in other embodiments offset directions for the staggered rows may be parallel to the layering direction L. FIGS. 7A-7C illustrate an actuator component 601 according to such an embodiment. In FIGS. 7A-7C, the same reference numerals are used as in FIGS. 1A-1C, but with an increment of 600.

Figure 7A:
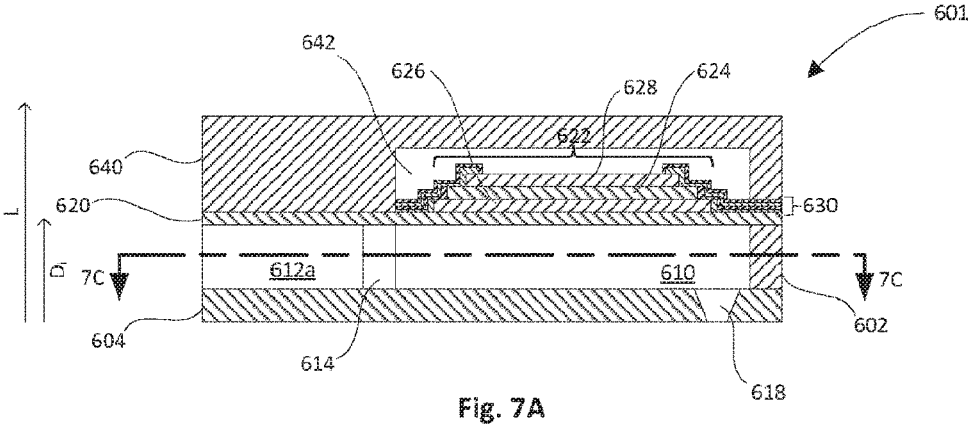
FIG. 7A is a plan view of a cross-section taken along the length of a fluid chamber of an actuator component according to yet another example embodiment, which is generally similar to the example embodiment of FIGS. 6A-6B, though the offset directions for the staggered rows are parallel to the layering direction.
Figure 7B:
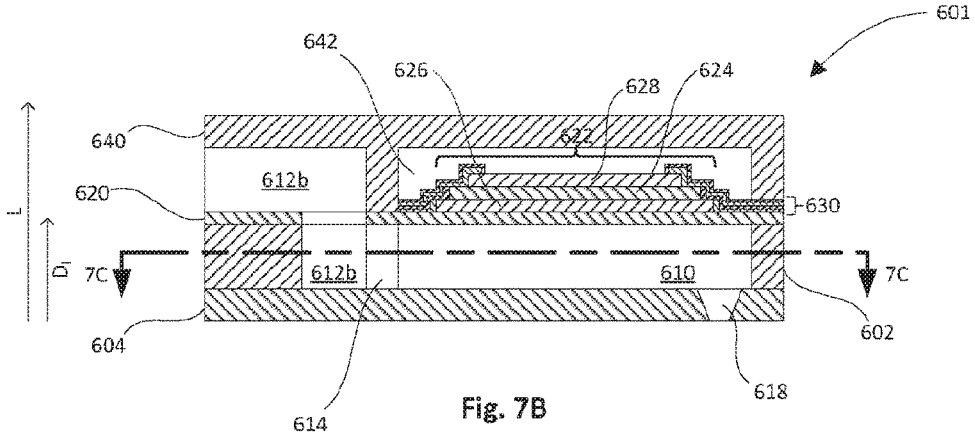
FIG. 7B is a plan view of a cross-section taken along the length of another fluid chamber of the actuator component shown in FIG. 7A, the fluid chamber shown in FIG. 7B belonging to a different group to the fluid chamber shown in FIG. 7A.
Figure 7C:
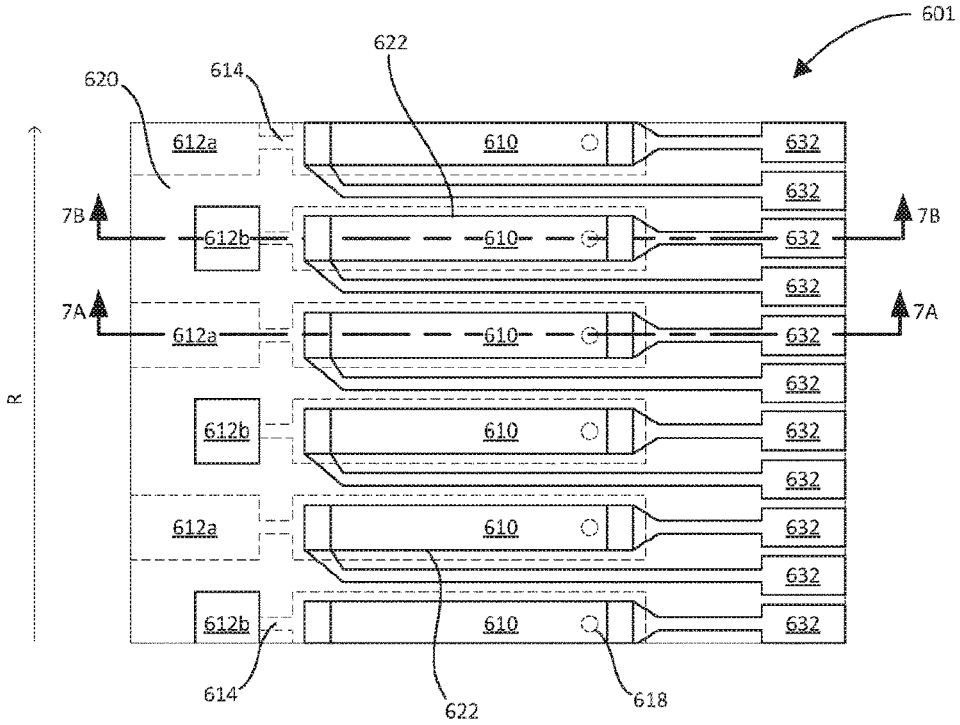
FIG. 7C is a plan view of the actuator component shown in FIGS. 7A and 7B from the side to which the capping layer is attached, with the capping layer removed so as to show clearly an illustrative configuration of electrical traces.

The actuator component 601 of the example embodiment of FIGS. 7A-7C is a modification of the example embodiment of FIGS. 6A-6B and therefore should be understood as having generally the same structure and functionality as the actuator component 501 of that example embodiment, except where stated below.

As may be seen from FIGS. 7A and 7B, which are plan views of cross-sections along the lengths of respective chambers 610, the actuator component 601 includes a number of patterned layers that are stacked in layering direction L, with each layer extending in a plane perpendicular to this layering direction L.

In the particular actuator component 601 shown in FIG. 7A, the patterned layers include nozzle layer 604, fluid chamber substrate layer 602, membrane layer 620, wiring and passivation layers 630, and capping layer 640 (in that order).

As may also be seen from FIGS. 7A and 7B, each chamber 610 is provided with an inlet passageway 612 only (and not an outlet passageway).

In more detail, each inlet passageway 612 is fluidically connected so as to supply fluid to one end of a respective one of the row of fluid chambers 610. Specifically, each inlet passageway 612 supplies fluid to the end in question of the corresponding fluid chamber 610 via a respective flow restrictor passage 614. A nozzle 618 for the chamber 610 is located at the opposing end of the chamber 610. In the particular arrangement shown in FIGS. 7A-7C, the chamber 610 is elongate with the nozzle 618 being located at one longitudinal end and the inlet passageway being fluidically connected to the opposite longitudinal end.

In contrast to the example embodiment of FIGS. 6A-6B, each inlet passageway 612 extends generally parallel to the length of the corresponding one of the fluid chambers 610.

In further contrast to the example embodiment of FIGS. 6A-6B, while the row of inlet passageways 612 is staggered, the row of fluid chambers 610 is linearly-aligned. Specifically, the row of fluid chambers 610 is aligned along a line extending in the row direction R (which is into the page in FIGS. 7A and 7B). This is apparent from a comparison of FIG. 7A with 7B: while the inlet passageway 612*b* shown in FIG. 7B is offset in layering direction L from the inlet passageway 612*a* shown in FIG. 7A, the corresponding fluid chambers 610 are aligned in layering direction L.

It should be noted that, as in the example embodiments of FIGS. 2, 3, 5 and 6, the inlet passageways 612 are assigned alternately to group "a" (such passageways being indicated in the drawing by 612*a*) and to group "b" (such passageways being indicated in the drawing by 612*b*), with inlet passageways within a particular group 612*a*, 612*b* being aligned in the inlet passageway offset direction, which is layering direction L.

However, in contrast to the example embodiments of FIGS. 2, 3, 5 and 6, the inlet passageways 612 assigned to a particular group are formed in a respective, distinct subset of the layers. Thus, the subset of layers in which the inlet passageways 612*a* assigned to group "a" are formed is distinct from the subset of layers in which the inlet passageways 612*b* of group "b" are formed.

More particularly, as is apparent from FIGS. 7A-7C, the inlet passageways 612*a* belonging to group "a" are provided within fluid chamber substrate layer 602, where they extend parallel to membrane layer 620 (and perpendicular to row direction R, which is into the page in FIG. 7A).

As is shown in FIG. 7B, in the particular example embodiment of FIGS. 7A-7C, the inlet passageways 612*b* belonging to group "b" are provided substantially within capping layer 640, where they extend parallel to membrane layer 620 (and perpendicular to row direction R, which is into the page in FIG. 7B). As may also be seen from FIG. 7B, each of the inlet passageways 612*b* of group "b" extends at one end through membrane layer 620 so as to connect with the corresponding one of the flow restrictor passages 614.

The orientation of the inlet passageways of the two groups with respect to the membrane layer 620 is further illustrated by FIG. 7C, which is a plan view of the actuator component 601 from the side to which the capping layer 640 is attached, with the capping layer 640 removed so as to show clearly an illustrative configuration of the electrical traces 632 on membrane layer 620. In FIG. 7C, the fluid chambers 610, flow restrictor passages 614 and nozzles 618, which are located on the far side of the membrane 620 in the view of FIG. 7C, are depicted with dashed lines so as show clearly their orientations relative to the traces 632, inlet passageways 612 and the actuating elements 622.

In the illustrative configuration shown in FIG. 7C, each actuating element 622 is electrically connected to two traces 632. As is apparent from FIG. 7C, the traces 632 extend in a plane having a normal in the layering direction L. Further, while the two traces 632 for each actuating element 622 originate at opposite ends of the actuating element 622, they both extend in the same direction and towards the same side of the membrane layer 620. This may be contrasted with the initial design of FIG. 10, where the two traces 32 for an actuating element 22 extend in opposite directions towards opposite sides of the membrane layer 20.

As is apparent from a comparison of FIG. 7A with FIG. 7C, although the inlet passageways 612*b* of group "b" cross this plane, they do not pass between conductive traces 32, as the traces 32 are routed to the opposite side of the surface of membrane layer 620.

As discussed above with reference to FIGS. 2 to 6, an end of each of the inlet passageways 612 may open to the exterior of the actuator component 601, so as to receive fluid from exterior the actuator component. Alternatively, the actuator component 601 may include one or more inlet ports that are similar to those described above with reference to FIG. 1D, but which may be provided at the sides of the actuator component with respect to the layering direction L, in contrast to the inlet port 15 shown in FIG. 1D. Where the inlet ports are provided on the side of the actuator component 601, they may have sufficient width in the layering direction to account for the staggering of the row of inlet passageways 612, or may be shaped so as correspond to the staggering of the row of the inlet passageways 612, for example having a zig-zag or serpentine shape. Regardless of their positioning, such inlet ports are configured to receive fluid from the exterior of the actuator component 601.

While in the example embodiment of FIGS. 7A-7C the chambers 610 and nozzles 618 are illustrated as being aligned in like manner, in other embodiments the row of nozzles could be staggered, with the row of chambers being aligned.

Figure 8A:
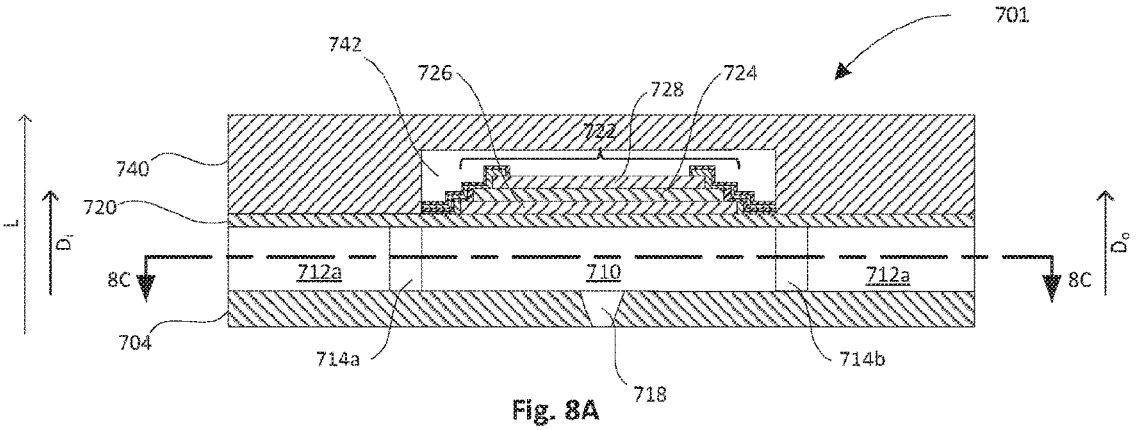
FIG. 8A is a plan view of a cross-section taken along the length of a fluid chamber of an actuator component according to yet another example embodiment, which is generally similar to the example embodiments of FIGS. 2-6B, though the offset directions for the staggered rows are parallel to the layering direction.
Figure 8B:
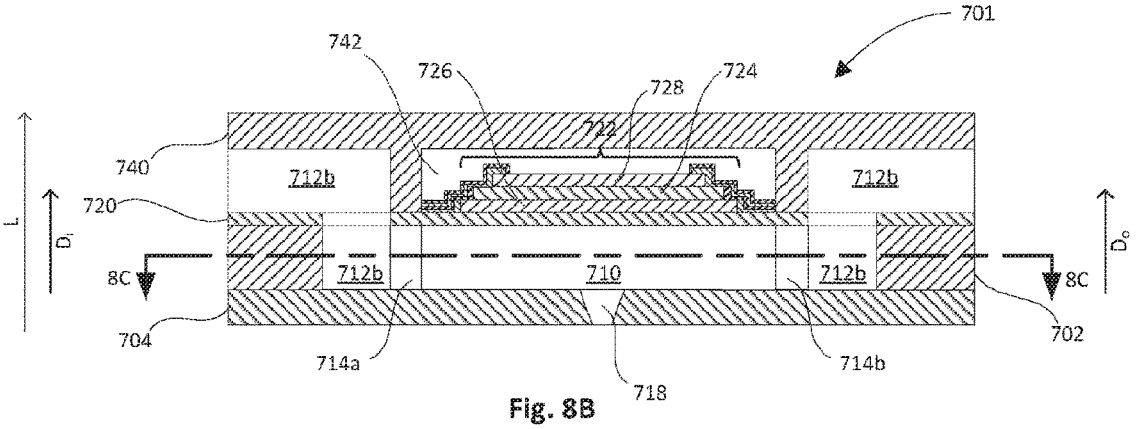
FIG. 8B is a plan view of a cross-section taken along the length of another fluid chamber of the actuator component shown in FIG. 8A, the fluid chamber shown in FIG. 8B belonging to a different group to the fluid chamber shown in FIG. 8A.
Figure 8C:
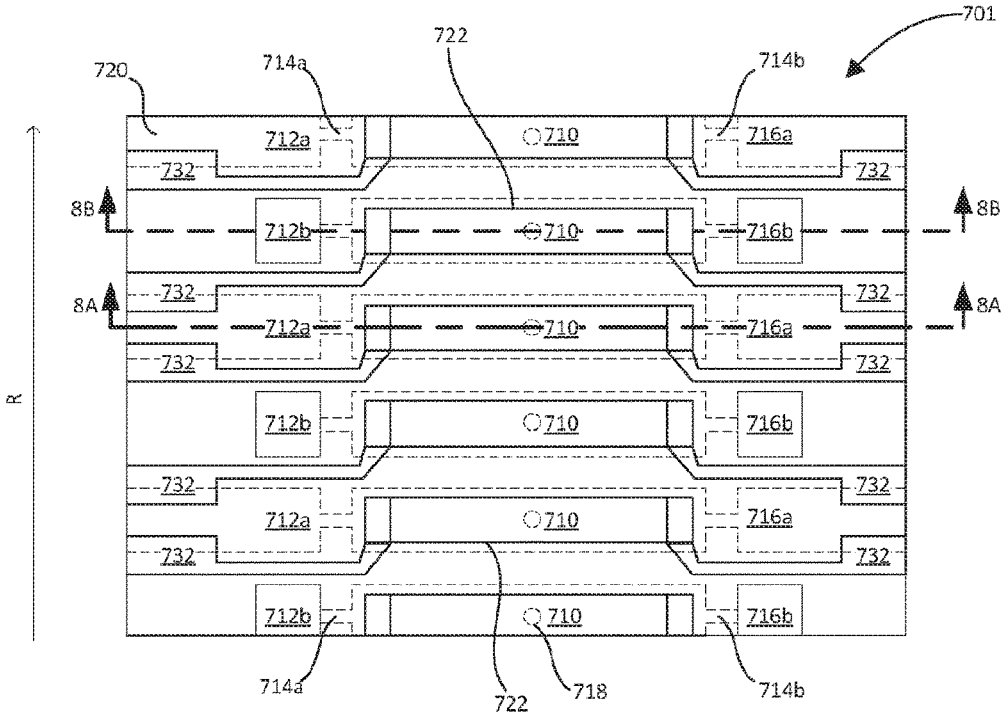
FIG. 8C is a plan view of the actuator component shown in FIGS. 8A and 8B from the side to which the capping layer is attached, with the capping layer removed so as to show clearly an illustrative configuration of electrical traces.

FIGS. 8A-8C illustrate a further example embodiment with staggered rows whose offset directions $D_i$, $D_o$ are parallel to the layering direction L, as in the example embodiment of FIGS. 7A-7C; however, in contrast to the example embodiment of FIGS. 7A-7C, in the example embodiment of FIGS. 8A-8C there is both an inlet passageway 712 and an outlet passageway 716 for each chamber 710 (for example to enable the actuator component 701 to be incorporated in a droplet deposition head configured for use in a recirculation mode).

In FIGS. 8A-8C, the same reference numerals are used as in FIGS. 1A-1C, but with an increment of 700.

As may be seen from FIGS. 8A and 8B, which are plan views of cross-sections along the lengths of respective chambers 710, the actuator component 701 includes a number of patterned layers that are stacked in layering direction L, with each layer extending in a plane perpendicular to this layering direction L.

A row of fluid chambers 710, a row of inlet passageways 712 and a row of outlet passageways 716 are formed within the layers of the actuator component 701, with each of these rows extending in row direction R, which is perpendicular to the layering direction L.

In the particular actuator component 701 shown in FIGS. 8A-8C, the patterned layers include nozzle layer 704, fluid chamber substrate layer 702, membrane layer 720, wiring and passivation layers, and capping layer 740 (in that order).

As is apparent from a comparison of FIG. 8A with FIG. 8B, the row of inlet passageways 712 is staggered, with a number of the inlet passageways 712 being offset from their neighbours in an inlet passageway offset direction $D_i$, which is the same as the layering direction L. The row of outlet passageways 716 is similarly staggered, with a number of the outlet passageways 716 being offset from their neighbours in an outlet passageway offset direction $D_o$, which again is the same as the layering direction L.

More particularly, as in the example embodiments of FIGS. 2, 3, and 5, the inlet passageways 712 are assigned alternately to group "a" (such passageways being indicated in the drawing by 712*a*) and to group "b" (such passageways being indicated in the drawing by 712*b*), with inlet passageways within a particular group 712*a*, 712*b* being aligned in the inlet passageway offset direction $D_i$. Similarly, the outlet passageways 716 are assigned to the same groups "a" and "b" (with membership of a group being indicated by the suffix "a" or "b", as before), with outlet passageways within a particular group 716*a*, 716*b* being aligned in the outlet passageway offset direction $D_o$. Inlet passageways 712 and outlet passageways 716 corresponding to the same chamber 710 are assigned to the same one of groups "a" and "b".

However, in contrast to the example embodiments of FIGS. 2, 3, 5 and 6, the inlet passageways 712 and outlet passageways 716 assigned to a particular group are formed in a respective, distinct subset of the layers. Thus, the subset of layers in which the inlet and outlet passageways 712*a*, 716*a* of group "a" are formed is distinct from the subset of layers in which the inlet and outlet passageways 712*b*, 716*b* of group "b" are formed.

In more detail, as is apparent from FIGS. 8A and 8C, in the particular example embodiment of FIGS. 8A-8C, the inlet passageways 712*a* belonging to group "a" are provided within fluid chamber substrate layer 702, where they extend parallel to membrane layer 720 (and perpendicular to row direction R, which is into the page in FIG. 8A).

The outlet passageways 716*a* belonging to group "a" are similarly provided within fluid chamber substrate layer 702 and also extend parallel to membrane layer 720.

As is apparent from a comparison of FIGS. 8B and 8C, in the particular example embodiment of FIGS. 8A-8C, the inlet passageways 712*b* belonging to group "b" are provided substantially within capping layer 740, where they extend parallel to membrane layer 720 (and perpendicular to row direction R, which is into the page in FIG. 8B). The inlet passageways 712*b* belonging to group "b" are therefore defined between the membrane layer 720 and the capping layer 740. As may also be seen from FIG. 8B, each of the inlet passageways 712*b* of group "b" extends at one end through membrane layer 720 so as to connect with the corresponding one of the flow restrictor passages 714*a*.

The outlet passageways 716*b* belonging to group "b" are similarly provided substantially within capping layer 740 and similarly extend parallel to membrane layer 720 (and perpendicular to row direction R, which is into the page in FIG. 8B). The outlet passageways 716*b* belonging to group "b" are therefore defined between the membrane layer 720 and the capping layer 740. As may also be seen from FIG. 8B, each of the outlet passageways 716*b* of group "b" extends at one end through membrane layer 720 so as to connect with the corresponding one of the flow restrictor passages 714*b*.

The orientation of the inlet passageways 712 and outlet passageways 716 of the two groups with respect to the membrane layer 720 is further illustrated by FIG. 8C, which is a plan view of the actuator component 701 from the side to which the capping layer 740 is attached, with the capping layer 740 removed so as to show clearly an illustrative configuration of electrical traces 732 on membrane layer 720. In FIG. 8C, the fluid chambers 710, flow restrictor passages 714*a*, 714*b* and nozzles 718, which are located on the far side of the membrane 720 in the view of FIG. 8C, are depicted with dashed lines so as show clearly their orientations relative to the traces 732, inlet passageways 712, outlet passageways 716 and the actuating elements 722.

In the illustrative configuration shown in FIG. 8C, each actuating element 722 is electrically connected to two traces 732. As is apparent from FIG. 8C, the traces 732 extend in a plane having a normal in the layering direction L. The inlet passageways 712*b* of group "b" cross this plane, with each such inlet passageway 712*b* passing between conductive traces 732. As FIG. 8C shows, one trace passes between each pair of neighbouring inlet passageways 712 in group "b" (as the trace in question passes from one side of the row of inlet passageways 712 to the other). The outlet passageways 716*b* in group "b" likewise cross this plane, with each outlet passageway 716*b* in group "b" passing between conductive traces 732. As FIG. 10 shows, one trace passes between each pair of neighbouring outlet passageways 716*b* in group "b" (as the trace in question passes from one side of the row of outlet passageways 716 to the other).

As may also be seen from FIG. 8C, the two traces 732 for each actuating element 722 originate at opposite ends of the actuating element 722 and extend in opposite directions towards opposite sides of the membrane layer 20, where bond pads may be provided for electrical connection to drive circuitry. This may be contrasted with the example embodiment of FIGS. 7A-7C, where the two traces 632 for an actuating element 622 extend in the same direction towards the same side of membrane layer 620.

As is also apparent from FIG. 8C, traces 732 for neighbouring chambers 710 are routed such that they overlie, in layering direction L, either an inlet passageway 712*a* or an outlet passageway 716*a* in group "a". This may reduce the potential for traces 732 to be exposed to fluid within the inlet passageways 712*b* or outlet passageways 716*b* in group "b", which, as noted above, are defined between the membrane layer 720—on which the traces 732 are provided—and the capping layer 740.

As discussed above with reference to FIGS. 2 to 7, an end of each of the inlet passageways 712 and outlet passageways 716 may open to the exterior of the actuator component 701, so as to respectively receive fluid from and convey fluid to exterior the actuator component.

Alternatively, the actuator component 701 may include inlet and outlet ports that are similar to those described above with reference to FIG. 1D, but which may be provided at the sides of the actuator component 701 with respect to the layering direction L, in contrast to the inlet port 15 and outlet port 19 shown in FIG. 1D. Where the inlet and/or outlet ports are provided on the side of the actuator component 701, they may have sufficient width in the layering direction L to account for the staggering of the rows of inlet passageways 712 and outlet passageways 716, or may be shaped so as correspond to the staggering of the rows of the inlet passageways 712 and outlet passageways 716, for example having a zig-zag or serpentine shape.

Regardless of their positioning, such inlet and outlet ports are respectively configured to receive fluid from and convey fluid to the exterior of the actuator component 701.

While in the example embodiment of FIGS. 8A-8C the chambers 710 and nozzles 718 are illustrated as being aligned in like manner, in other embodiments the row of nozzles could be staggered, with the row of chambers being aligned.

Although in FIGS. 1-8 the inlet passageways and outlet passageways are depicted as having rectangular cross-sections, it should be understood that the cross-section (specifically the cross-section taken perpendicular to the length of an inlet/outlet passageway) may take a variety of shapes. For example, the cross-section may be triangular shaped, square shaped, rectangular shaped, pentagonal shaped, hexagonal shaped, rhombus shaped, oval shaped or circular shaped.

In addition, or instead, the cross-sections may be shaped so as to have symmetry about an axis parallel to the row direction R. Examples of such cross-sections are illustrated in FIGS. 9A-9C.

Figure 9A:
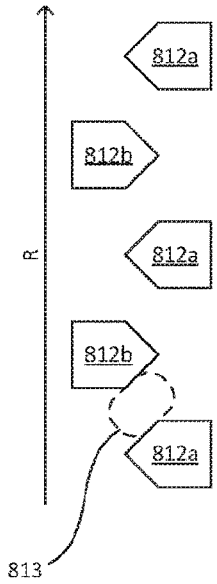
FIGS. 9A, 9B, and 9C are plan views of cross-sections, each of which is taken through a number of inlet passageways according to a respective example design in which the inlet passageways are shaped so as to have symmetry about an axis parallel to the row direction.

FIG. 9A shows an example where the inlet passageways 812 have been assigned to two offset groups, group "a" and group "b", as described above with reference to FIGS. 2, 3, 5, 6, 7 and 8. As may be seen from the drawing, the cross-sectional shape of each inlet passageway from the first group 812*a* is symmetric with that of each inlet passageway from the second group 812*b* about an axis parallel to the row direction R. As a result, the amount of wall 813 separating adjacent inlet passageways 812*a*, 812*b* is increased, as compared with inlet passageways having rectangular cross-sections.

Figure 9B:
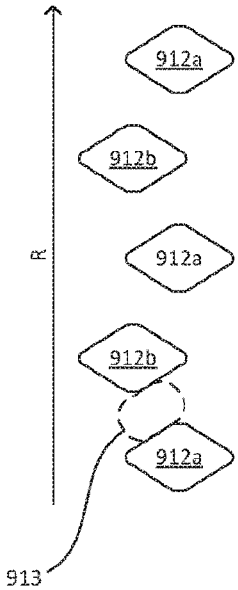

FIG. 9B shows a further example where the inlet passageways 912 have been likewise assigned to two offset groups, group "a" and group "b". As may be seen from the drawing, the cross-sectional shape of each inlet passageway from the first group 912*a* is not only symmetric with that of each inlet passageway from the second group 912*b* about an axis parallel to the row direction R, but is also self-symmetric about such an axis. As a result, the amount of wall 913 separating adjacent inlet passageways 912*a*, 912*b* is again increased, as compared with inlet passageways having rectangular cross-sections, such as those shown in FIG. 2.

Figure 9C:
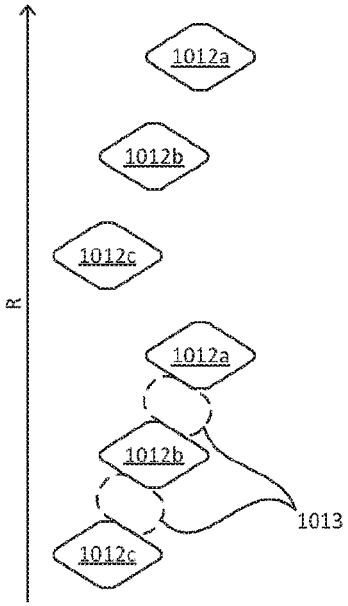

FIG. 9C shows an example in which the inlet passageways 1012 have been cyclically assigned to three offset groups, group "a", group "b", and group "c". As may be seen from the drawing, the cross-sectional shape of each inlet passageway is self-symmetric about an axis parallel to the row direction R. As a result, the amount of wall 1013 separating adjacent inlet passageways 1012*a*, 1012*b* from groups "a" and "b" is increased, as is the amount of wall 1013 separating adjacent inlet passageways 1012*b*, 1012*c* from groups "b" and "c", as compared with inlet passageways having rectangular cross-sections.

Figure 10A:
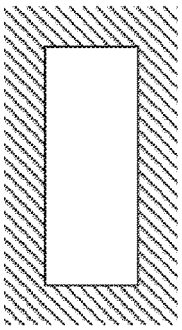
Figure 10B:
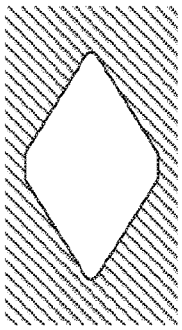
Figure 10C:
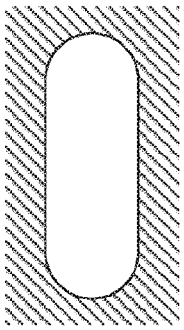

FIGS. 10A-10C illustrate still further examples of suitable self-symmetric cross-sectional shapes for the fluid inlet and/or outlet passageways. Specifically, FIGS. 10A-10C show, respectively, a rectangular-shaped cross-section, a (truncated) rhombus-shaped cross-section, and a stadium-shaped cross-section.

Figure 11A:
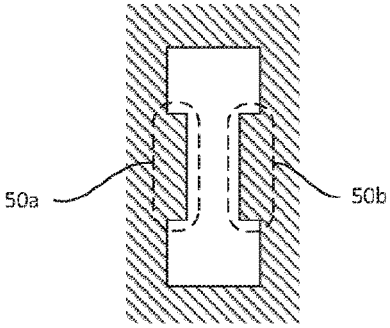
FIGS. 11A, 11B, and 11C are plan views of cross-sections, each of which is taken through a modified version of the inlet passageway shown in, respectively, FIG. 10A, FIG. 10B, and FIG. 10C, the modified versions including strengthening ribs of the inlet passageway's length.
Figure 11B:
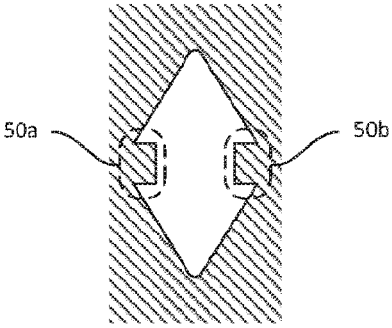
Figure 11C:
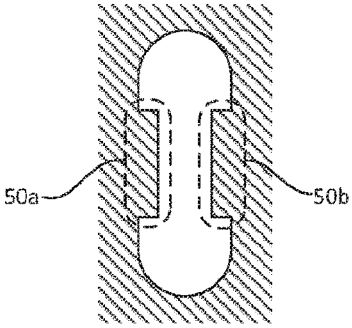

FIGS. 11A-11C then illustrate modifications to the cross-sectional shapes shown in FIGS. 10A-10C respectively. More particularly, FIGS. 11A-11C illustrate the inclusion of an additional wall portion 50*a*, 50*b* on each longitudinal side of the cross-sectional shape. The inclusion of each such additional portion 50*a*, 50*b* is equivalent to the inclusion of a strengthening rib on either side of the inlet passageway's length, each strengthening rib extending parallel to the length of the inlet passageway. Such strengthening ribs may further reduce cross-talk between adjacent chambers.

It will of course be understood that in other embodiments more than two, or only one such rib might be utilised.

While in the embodiments described above with reference to FIGS. 2-5 above both the row of inlet passageways and the row of outlet passageways have been described as being staggered, in other embodiments only one of these rows might be staggered, as at least some such embodiments may be expected to experience some moderation of crosstalk, even though staggering both rows in those embodiments might provide less crosstalk still.

Although in the embodiments described above with reference to FIGS. 2-8 the members of each staggered row are assigned to the same two or more groups this is by no means essential. Thus, in other embodiments, the inlet passageways could, for example, be assigned to three groups, with the outlet passageways being assigned to only two groups. In still other embodiments the inlet passageways and the outlet passageways could be assigned to the same number of groups (e.g. three), but with these groups being specific to the staggered row in question.

The actuator components described above with reference to FIGS. 2-8 may, for example, be fabricated using processes typically used to fabricate structures for Micro-Electro-Mechanical Systems (MEMS). In such cases, the actuator components may be described as being MEMS actuator components (it being noted that this carries with it no implication as to the type of actuating element utilised: for instance, actuator components with thermal actuating elements are referred to within the art as MEMS actuator components regardless of the fact that they do not include electromechanical actuating elements).

Though the foregoing description has presented a number of examples, it should be understood that other examples and variations are contemplated within the scope of the appended claims.

It should be noted that the foregoing description is intended to provide a number of non-limiting examples that assist the skilled reader's understanding of the present invention and that demonstrate how the present invention may be implemented.

The invention claimed is:

1. An actuator component for a droplet deposition head comprising:

a plurality of layers, each layer extending in a plane having a normal in a layering direction, the layers being stacked in the layering direction;

fluid chambers formed within the plurality of layers, the fluid chambers arranged in a corresponding row extending in a row direction, which is perpendicular to the layering direction, each fluid chamber being provided with a nozzle and an actuating element, each actuating element being actuable to cause ejection of fluid from a respective chamber through a corresponding nozzle;

inlet passageways formed within the plurality of layers, the inlet passageways arranged in a corresponding first row extending in the row direction, each inlet passageway being fluidically connected to one of the fluid chambers;

wherein at least a subset of the inlet passageways is in a first staggered row, whereby at least the inlet passageways of the first staggered row are offset from neighboring inlet passageways in a first offset direction that is perpendicular to the row direction; and wherein at least a subset of the fluid chambers is in a second staggered row, whereby at least the fluid chambers of the second staggered row of fluid chambers are offset from neighboring fluid chambers in a second offset direction that is perpendicular to the row direction.

2. The actuator component of claim 1, further comprising further inlet passageways formed within the plurality of layers, the further inlet passageways formed within the plurality of layers being arranged in a second row of inlet passageways extending in the row direction, each inlet passageway being fluidically connected to one of the fluid chambers and each fluid chamber having separate connections to one inlet passageway of the first row and one of the inlet passageways of the second row.

3. The actuator component of claim 2, wherein at least one inlet passageway of the second row of inlet passageways is in a third staggered row of inlet passageways, whereby at least the members of the third staggered row of inlet passageways are offset from neighboring inlet passageways in an offset direction that is perpendicular to the row direction.

4. The actuator component of claim 3, wherein the members of each of the first, second and third staggered rows are assigned, according to a repeating pattern, to two or more groups corresponding to the respective staggered row and for each one of the staggered rows, members within the same group are aligned in the offset direction for the respective staggered row and members within different groups are offset by a distance in the offset direction for the respective staggered row.

5. The actuator component of claim 4, wherein the members of each group are formed in a subset of the layers and for at least one of the staggered rows, the subset of layers for one group row is different to the subset of layers for another group.

6. The actuator component of claim 3, wherein each of the inlet passageways of the second row of inlet passageways is elongate in a direction parallel to a second inlet passageway length direction, wherein the second inlet passageway length direction is perpendicular to the layering direction and wherein each inlet passageway of the second row of inlet passageways comprises a second inlet passageway wall and for at least a group of the inlet passageways of the second row of inlet passageways, each second inlet passageway wall includes at least one strengthening rib, which extends parallel to the second inlet passageway length direction.

7. The actuator component of claim 3, wherein each of the inlet passageways of the second row of inlet passageways is elongate in a direction parallel to a second inlet passageway length direction, wherein the second inlet passageway length direction is parallel to the layering direction and wherein each inlet passageway of the second row of inlet passageways comprises a second inlet passageway wall and for at least a group of the inlet passageways of the second row of inlet passageways, each second inlet passageway wall includes at least one strengthening rib, which extends parallel to the second inlet passageway length direction.

8. The actuator component of claim 1, further comprising outlet passageways formed within the plurality of layers, the outlet passageways being arranged in a row of outlet passageways extending in the row direction, each outlet passageway being fluidically connected to one of the fluid chambers.

9. The actuator component of claim 8, wherein at least one of the outlet passageways is in a fourth staggered row of outlet passageways, whereby at least the members of the fourth staggered row of outlet passageways are offset from neighboring outlet passageways in an offset direction that is perpendicular to the row direction.

10. The actuator component of claim 9, wherein the members of each first, second and fourth staggered rows are assigned, according to a repeating pattern, to two or more groups corresponding to the respective staggered row and for each one of the staggered rows, members within the same group are aligned in the offset direction for the respective staggered row and members within different groups are offset by a distance in the offset direction for the respective staggered row.

11. The actuator component of claim 10, wherein the members of each group are formed in a subset of the layers and for at least one of the staggered rows, the subset of layers for one group is different to the subset of layers for another group.

12. The actuator component of claim 9, wherein each of the outlet passageways is elongate in a direction parallel to an outlet passageway length direction, wherein the outlet passageway length direction is perpendicular to the layering direction and wherein each outlet passageway comprises an outlet passageway wall and for at least a group of the outlet passageways, each outlet passageway wall includes at least one strengthening rib, which extends parallel to the outlet passageway length direction.

13. The actuator component of claim 9, wherein each of the outlet passageways is elongate in a direction parallel to an outlet passageway length direction, wherein the outlet passageway length direction is parallel to the layering direction and wherein each outlet passageway comprises an outlet passageway wall and for at least a group of the outlet passageways, each outlet passageway wall includes at least one strengthening rib, which extends parallel to the outlet passageway length direction.

14. The actuator component of claim 1, wherein members of each first and second staggered rows are assigned, according to a repeating pattern, to two or more groups corresponding to the respective staggered row and for each one of the staggered rows, members within the same group are aligned in an offset direction for the respective staggered row and members within different groups are offset by a distance in the offset direction for respective staggered rows.

15. The actuator component of claim 14, wherein the members of each group are formed in a subset of the layers and for at least one of the staggered rows, the subset of layers for one group is different to the subset of layers for another group.

16. The actuator component of claim 1, wherein each of the inlet passageways is elongate in a direction parallel to a first inlet passageway length direction, wherein the first inlet passageway length direction is perpendicular to the layering direction and wherein each inlet passageway comprises a first inlet passageway wall and for at least a group of the inlet passageways, each first inlet passageway wall includes at least one strengthening rib, which extends parallel to the first inlet passageway length direction.

17. The actuator component of claim 1, wherein each of the inlet passageways is elongate in a direction parallel to a first inlet passageway length direction, wherein the first inlet passageway length direction is parallel to the layering direction and wherein each inlet passageway comprises a first inlet passageway wall and for at least a group of the inlet passageways, each first inlet passageway wall includes at least one strengthening rib, which extends parallel to the first inlet passageway length direction.

18. The actuator component of claim 1, further comprising a plurality of conductive traces extending in a plane having a normal in the layering direction and being provided on one of the plurality of layers, wherein the conductive traces provide at least part of an electrical connection between said actuating elements and drive circuitry and each inlet passageway crosses the plane in which the conductive traces are provided.

19. An actuator component for a droplet deposition head comprising:

a plurality of layers, each layer extending in a plane having a normal in a layering direction, the layers being stacked in the layering direction;

fluid chambers formed within the plurality of layers, the fluid chambers arranged in a corresponding row extending in an row direction, which is perpendicular to the layering direction, each fluid chamber being provided with a nozzle and an actuating element, each actuating element being actuable to cause ejection of fluid from a respective chamber through a corresponding nozzle; and inlet passageways formed within the plurality of layers, the inlet passageways being arranged in a corresponding row extending in the row direction, each inlet passageway being fluidically connected to one of the fluid chambers; and outlet passageways formed within the plurality of layers, the outlet passageways arranged in a row extending in the row direction, each outlet passageway being fluidically connected to one of the fluid chambers, wherein at least a subset of the outlet passageways is in a staggered row of outlet passageways, whereby at least the outlet passageways of the staggered row of outlet passageways are offset from neighboring outlet passageways in an offset direction that is perpendicular to the row direction.

20. A droplet deposition head comprising:

an actuator component for a droplet deposition head comprising:

a plurality of layers, each layer extending in a plane having a normal in a layering direction, the layers being stacked in the layering direction;

fluid chambers formed within the plurality of layers, the fluid chambers arranged in a corresponding row extending in a row direction, which is perpendicular to the layering direction, each fluid chamber being provided with a nozzle and an actuating element, each actuating element being actuable to cause ejection of fluid from a respective chamber through a corresponding nozzle;

inlet passageways formed within the plurality of layers, the inlet passageways arranged in a corresponding row extending in the row direction, each inlet passageway being fluidically connected to one of the fluid chambers; and wherein at least a subset of the inlet passageways is in a first staggered row, whereby at least the inlet passageways of the first staggered row are offset from neighboring inlet passageways in a first offset direction that is perpendicular to the row direction.

* * * * *